US007037061B2

(12) United States Patent
Hund, Jr. et al.

(10) Patent No.: US 7,037,061 B2
(45) Date of Patent: May 2, 2006

(54) REFUSE COLLECTION VEHICLE HAVING MULTIPLE COLLECTION ASSEMBLIES

(75) Inventors: Henry M. Hund, Jr., Cedar Bluff, AL (US); Mark A. Keller, Valley Head, AL (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 10/612,324

(22) Filed: Jul. 3, 2003

(65) Prior Publication Data

US 2005/0019140 A1 Jan. 27, 2005

Related U.S. Application Data

(62) Division of application No. 09/975,759, filed on Oct. 11, 2001, now Pat. No. 6,761,523.

(60) Provisional application No. 60/240,255, filed on Oct. 13, 2000.

(51) Int. Cl.
*B65F 3/04* (2006.01)

(52) U.S. Cl. ..... 414/408; 414/917

(58) Field of Classification Search ..... 414/406–409, 414/420, 555, 786, 785, 699, 700, 706, 708, 414/912

See application file for complete search history.

(56) References Cited

U.S. PATENT DOCUMENTS 3,204,789 A * 9/1965 Riedl et al. ..... 414/526
3,952,890 A * 4/1976 Armstrong ..... 414/694
4,401,407 A 8/1983 Breckenridge
4,543,028 A 9/1985 Bell et al.
4,566,840 A 1/1986 Smith
4,983,092 A 1/1991 Richards
5,007,786 A 4/1991 Bingman
5,026,104 A * 6/1991 Pickrell ..... 294/86.4
5,049,026 A 9/1991 Bingman et al.
RE34,292 E 6/1993 Bingman et al.
5,391,039 A 2/1995 Holtom
5,419,671 A 5/1995 Smith et al.
5,470,187 A 11/1995 Smith et al.
5,547,332 A 8/1996 Smith et al.
5,861,580 A * 1/1999 Moore et al. ..... 177/136
6,213,706 B1 4/2001 Christenson

* cited by examiner

*Primary Examiner*—Eileen D. Lillis
*Assistant Examiner*—Charles A. Fox
(74) *Attorney, Agent, or Firm*—Chambliss, Bahner & Stophel, P.C.

(57) ABSTRACT

A refuse collection vehicle includes a collection bin that is mounted on the vehicle frame, and an apparatus for acquiring, lifting and transferring a container so as to deposit the contents of the container in the collection bin. The vehicle also includes a collection compartment that is pivotally mounted on the rear of the vehicle, a storage compartment that is mounted on the frame between the collection bin and the collection compartment, and a packer blade that is mounted within the collection compartment and moveable so as to move refuse material from the collection compartment into the storage compartment.

6 Claims, 24 Drawing Sheets

REFUSE COLLECTION VEHICLE HAVING MULTIPLE COLLECTION ASSEMBLIES

CROSS REFERENCE TO RELATED APPLICATIONS

This application is a divisional application of U.S. patent application Ser. No. 09/975,759, entitled MECHANISM FOR DUMPING A REFUSE CONTAINER, which was filed on Oct. 11, 2001 now U.S. Pat. No. 6,781,523. This application also claims the benefit of U.S. Provisional Application No. 60/240,255, which was filed on Oct. 13, 2000, through the aformentioned parent application.

FIELD OF THE INVENTION

This invention relates generally to an improved refuse collection device, and more particularly, to an improved refuse collection device which is adapted to grab and lift a refuse container and dump the contents thereof into a collection bin. Preferably, the collection device is mounted on a refuse collection vehicle. Such device may be employed to grab and lift a residential-type refuse container from a curb-side or other convenient location, raise the container to dump it into a collection bin on the vehicle, and return the container to its original location.

BACKGROUND OF THE INVENTION

In recent years, the formerly labor-intensive process of collecting household refuse and recyclable materials has become increasingly automated, as improvements have been made to the vehicles employed in collecting such materials. Modem refuse collection vehicles typically include an integral refuse collection bin and a compaction mechanism for compacting materials in or adjacent to the collection bin. Such vehicles may introduce refuse into the collection bin from the front, rear or side of the vehicle. Some such vehicles include mechanized handling devices which include a holding or grasping assembly for holding a refuse container. These handling devices typically include a container access assembly which is adapted to move the holding assembly into position to grab a container, and to cooperate with the holding assembly to lift and dump the contents of the container in the collection bin of the vehicle. The container access assembly may then be used to return the container to its original position.

These holding assemblies and container access assemblies take many forms. Thus, for example, U.S. Pat. No. 4,401,407 of Breckenridge describes an apparatus which includes a telescoping container access assembly and a holding assembly which includes multiple pivoting arm components. U.S. Pat. No. 4,543,028 of Bell et al. describes an apparatus which includes an rail mounted access assembly that pivots about a horizontal axis to move the container into the dumping position. U.S. Pat. No. 4,566,840 of Smith describes an access assembly that includes a fixed frame portion to which is attached a linkage assembly that carries the holding assembly. U.S. Pat. No. 4,726,726 of Dossena et al. describes a telescoping access assembly to which is attached a holding assembly that rotates about a horizontal axis to dump the contents of a container into the collection bin. U.S. Pat. No. 4,983,092 of Richards describes a pivoting holding assembly that is mounted on a transverse guide rail. U.S. Pat. No. 5,007,786 of Bingman describes a refuse collection system which includes a holding assembly that is mounted on a carriage that rides in a vertical rail assembly to dump the contents of a container. U.S. Pat. No. Re. 34,292 of Bingman et al. describes an articulated boom assembly having a pair of gripping arms mounted on a carriage that moves along the outer arm of the assembly. U.S. Pat. No. 5,391,039 of Holtom describes a refuse loader arm that includes an articulated access assembly having inner and outer limbs that are joined by a parallelogram linkage that holds the holding assembly at a constant angle with respect to the inner limb. U.S. Pat. No. 5,419,671 and U.S. Pat. No. 5,547,332, both of Smith et al., describe a container handling assembly that is mounted on the top of the vehicle adjacent to the collection bin. U.S. Pat. No. 5,470,187 of Smith et al. describes a handling assembly having a fixed boom that pivots about a vertical axis adjacent to the vehicle frame, on which boom is mounted a vertically adjustable container holding assembly.

All of these known assemblies suffer from one or more of various disadvantages. Some of the known systems offer a limited reach in accessing a container. Some are unable to grab a container that is not on the same level as the vehicle. Some raise the container so high during the dumping portion of the operating cycle that the container and the holding portion of the assembly may come into contact with low-hanging power or telephone lines. Some are mechanically complex and difficult to operate. Some protrude from the vehicle on which they are mounted to such an extent that they present a risk of hitting other vehicles, mailboxes or other roadside obstacles. Some are slow to complete their operating cycle, and some are expensive to build and install. It would be desirable if a system could be developed that would overcome these disadvantages.

ADVANTAGES OF THE INVENTION

Among the advantages of the invention is that it affords a higher operating speed with a greater reach than was previously known for refuse collection and dumping devices.

Another advantage of the invention is that it has a lower dumping height and a lower retracted profile than was previously known for refuse collection and dumping devices.

Still another advantage of the invention is that it operates in a smoother manner than previously-known devices, which offers increased life of assembly components, improved reliability of operation, and a reduction in the vibrations that are transmitted to the operator compartment. Another advantage of a preferred embodiment of the invention lies in the fact that it employs a pair of primary hydraulic actuators (lift and reach actuators) which are arranged and configured so that the "stroke" of each of the actuators retracts the piston into the actuator body, so that if the seals of an actuator leak hydraulic fluid, the actuator will tend to retract the assembly rather than extend it.

Yet another advantage of a preferred embodiment of the invention is that it offers an enclosed gearbox for the grab assembly, which offers more protection for the components of the grab assembly and consequently improved operation of such components than previously-known devices.

Additional objects and advantages of this invention will become apparent from an examination of the drawings and the ensuing description.

EXPLANATION OF TECHNICAL TERMS

As used herein, the term "operating cycle" refers to the cycle during which the apparatus of the invention reaches for a container, grabs a container, lifts a container, dumps the container into a collection bin, returns the container to its point of origin, releases the container and retracts to its retracted or travel position.

As used herein, the terms "reach" and "extension" refer to that portion of the operating cycle during which the apparatus extends from its retracted or travel position to the location of a refuse container.

As used herein, the term "grab" refers to that portion of the operating cycle during which the apparatus acquires or grips the container so that it may be lifted.

As used herein, the term "lift" refers to that portion of the operating cycle during which the apparatus lifts the container so that it may be moved. The "lift" portion of the operating cycle may be begun simultaneously with the "dump" portion of the cycle.

As used herein, the term "dump" refers to that portion of the operating cycle during which the apparatus moves the lifted container upwardly and towards the collection bin, while tilting it so as to empty its contents when it is in position over the bin. The "dump" portion of the operating cycle may be begun simultaneously with the "lift" portion of the cycle.

As used herein, the term "return" refers to that portion of the operating cycle during which the apparatus lowers the container and returns it to its point of origin while tilting it to an upright attitude, after the contents of the container have been dumped into the collection bin. The "return" portion of the operating cycle include a lowering component and a retraction component.

As used herein, the term "release" refers to that portion of the operating cycle during which the apparatus disengages from the container at its point of origin.

As used herein, the terms "retract" and "retraction" refer to that portion of the operating cycle during which the apparatus returns to its travel position after releasing a container that has been emptied.

As used herein, the terms "retracted position" and "travel position" refer to the position of the apparatus adjacent to the collection bin prior to initiation of (or after completion of) the operating cycle. When the apparatus is mounted on a vehicle, the "retracted position" or "travel position" is the preferred position of the apparatus as the vehicle is moved along a street or roadway.

As used herein, the term "pivot" defines a pivotal axis and may include one or more components that permit one or more members to pivot with respect to another member or members, including, for example, pivot pins, collars and bearings such as are known to those having ordinary skill in the art to which the invention relates.

As used herein, the term "upright attitude" refers to the orientation of the container with respect to the apparatus (or with respect to the vehicle on which the apparatus is mounted) prior to initiation of the operating cycle. The axis through the center of mass of a container in an "upright attitude" may vary from a vertical axis.

SUMMARY OF THE INVENTION

The invention comprises an apparatus for acquiring, lifting and transferring a container so as to deposit its contents in a collection bin. The apparatus includes a container grab assembly which includes a pair of opposed grabbing arms that are aligned in spaced relationship and operable by a fluid-operated actuating system to grab and release a container. The apparatus also includes an articulated, moveable arm assembly that is operable by a fluid-operated actuating system through an operating cycle that includes retracted, extended, lifting and dumping positions. The arm assembly includes a base link that is mounted adjacent to the collection bin, and an upper link having a first end and a second end. The arm assembly also includes a reach link having a first end and a second end, said first end being pivotally attached to the base link and said second end being pivotally attached to the upper link at a first intermediate position between the first end of the upper link and the second end. The arm assembly also includes a lift arm having a first end and a second end, said first end being pivotally attached to the grab assembly and said second end being pivotally attached to the first end of the upper link.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described herein.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
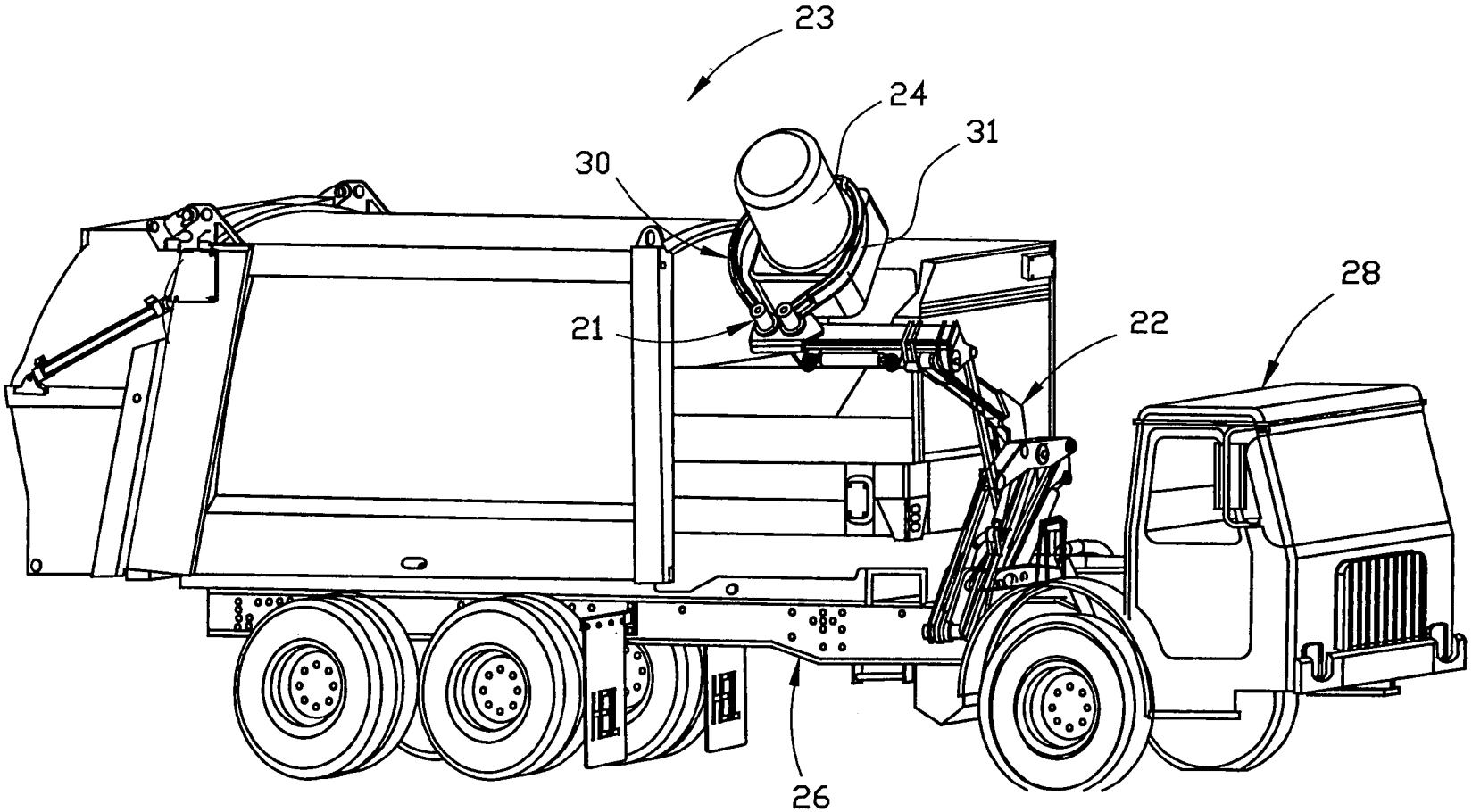
FIG. 1 is a perspective view of a vehicle to which the invention is mounted, showing the invention in the dumping portion of the operating cycle.
Figure 2A:
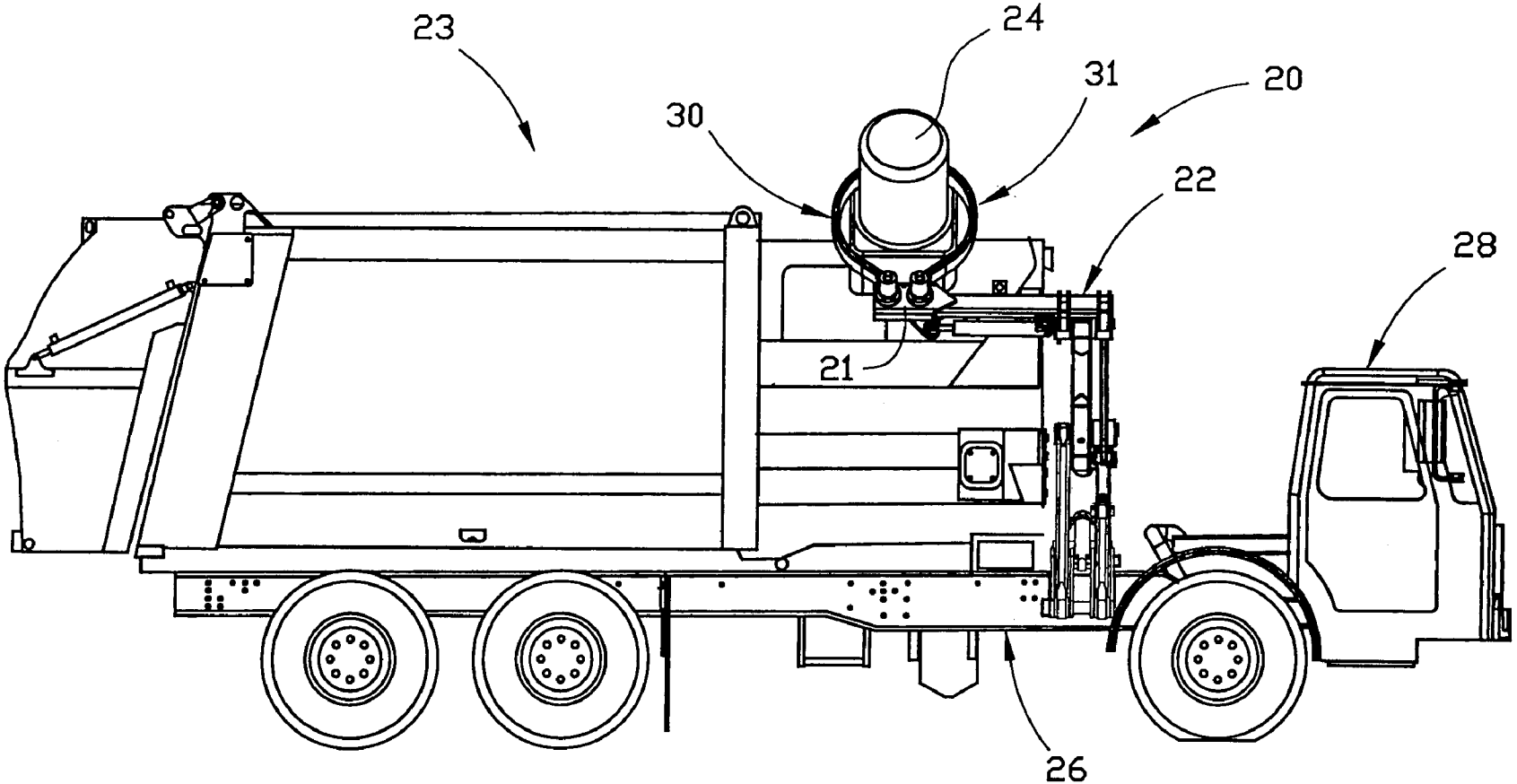
FIG. 2A is a side view of the vehicle of FIG. 1.
Figure 4:
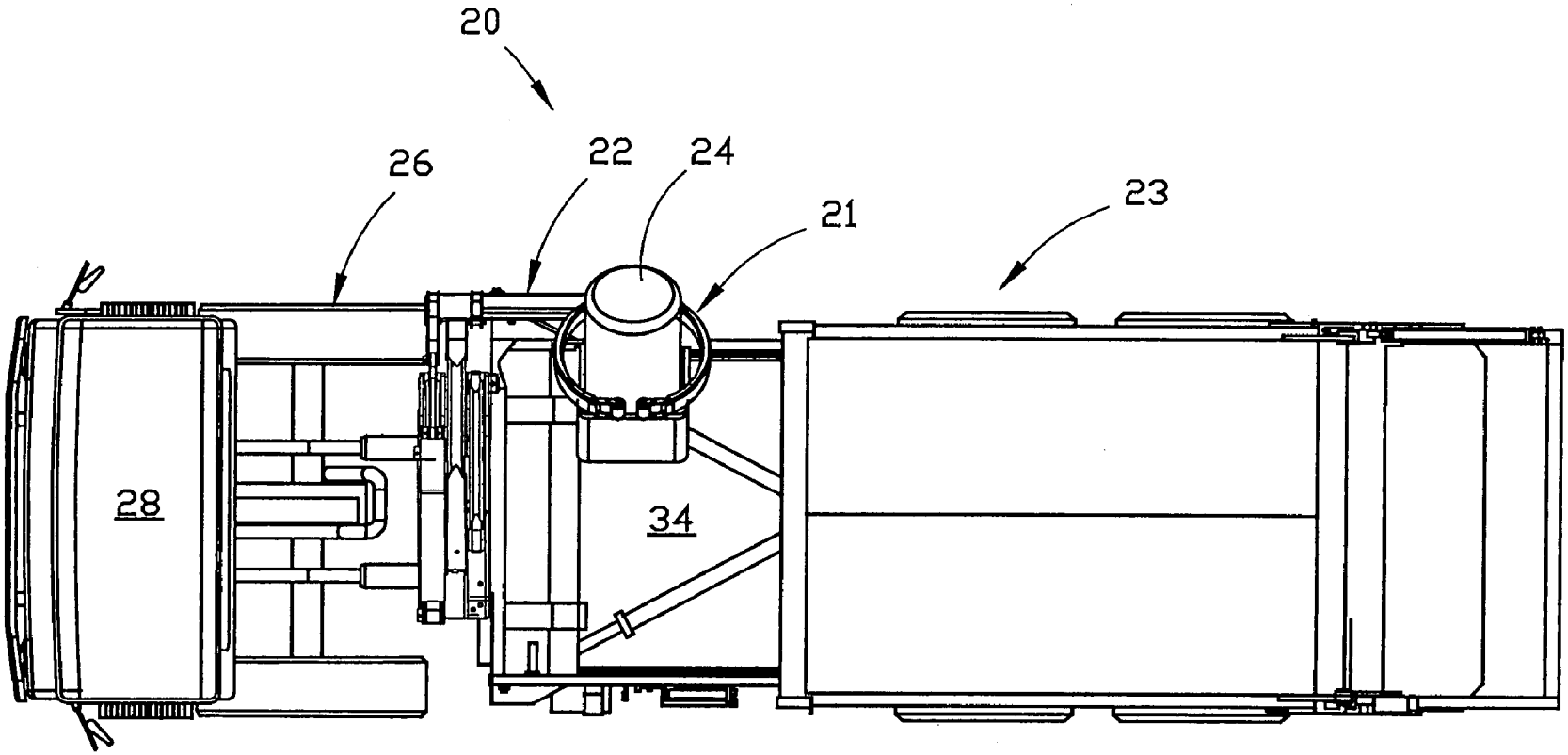
FIG. 4 is a top view of the vehicle of FIGS. 1, 2A and 3.

As shown in the drawings, the invention comprises an apparatus for grabbing or acquiring, lifting and transporting a container so as to deposit its contents in a collection bin. The preferred apparatus 20 includes container grab assembly 21 and articulated, moveable arm assembly 22. As shown in FIGS. 1, 2A, 3 and 4, preferred embodiment 20 of the invention is adapted for use in connection with a refuse collection vehicle such as vehicle 23, which may be used to collect trash and refuse from containers such as container 24 that are placed curbside (or at another convenient location) in a residential area. As shown in FIGS. 1, 2A and 4, arm assembly 22 of preferred grab and lift mechanism 20 is preferably attached (by welding, bolting or other suitable means) to frame 26 of the vehicle behind operator's cab 28. The arm assembly is operable by a fluid-operated actuating system (as described in more detail hereinafter) through an operating cycle that includes a retracted position (see FIGS. 5 through 8), an extended or reach position (see FIG. 10), a lifting position (see FIG. 14) and a dumping position (see FIGS. 15 and 16).

The preferred apparatus is suitable for grabbing, lifting and emptying containers having a cross-section that is generally cylindrical, square or rectangular, or of other convenient shape. The preferred grab assembly includes opposed grabbing arms 30 and 31 that are aligned in spaced relationship and operable by a fluid-operated actuating system to grab and release a container. The grabbing arms of the grab assembly 21 are preferably provided with flexible straps 32 (shown in FIG. 12 but omitted elsewhere for clarity) that permit the device to grab, lift and empty containers of various shapes.

The invention enables an operator to collect and dump refuse that is placed in containers that are located curbside, or at another convenient location accessible to the vehicle, without leaving the cab of the vehicle. Apparatus 20 operates through an operating cycle during which it reaches for a container, grabs the container, lifts the container, dumps the container into a collection bin such as vehicle-mounted bin 34 (see FIG. 4), returns the container to its point of origin, releases the container and retracts to its retracted or travel position. The lifting and dumping functions may be commenced simultaneously, and all functions are performed in a smooth manner because of the mechanical and hydraulic balance that is built into the apparatus. Vehicle 23 may also be provided with a compaction mechanism such as is known to those having ordinary skill in the art to which the invention relates that is employed to compact the refuse in the collection bin.

Figure 2B:
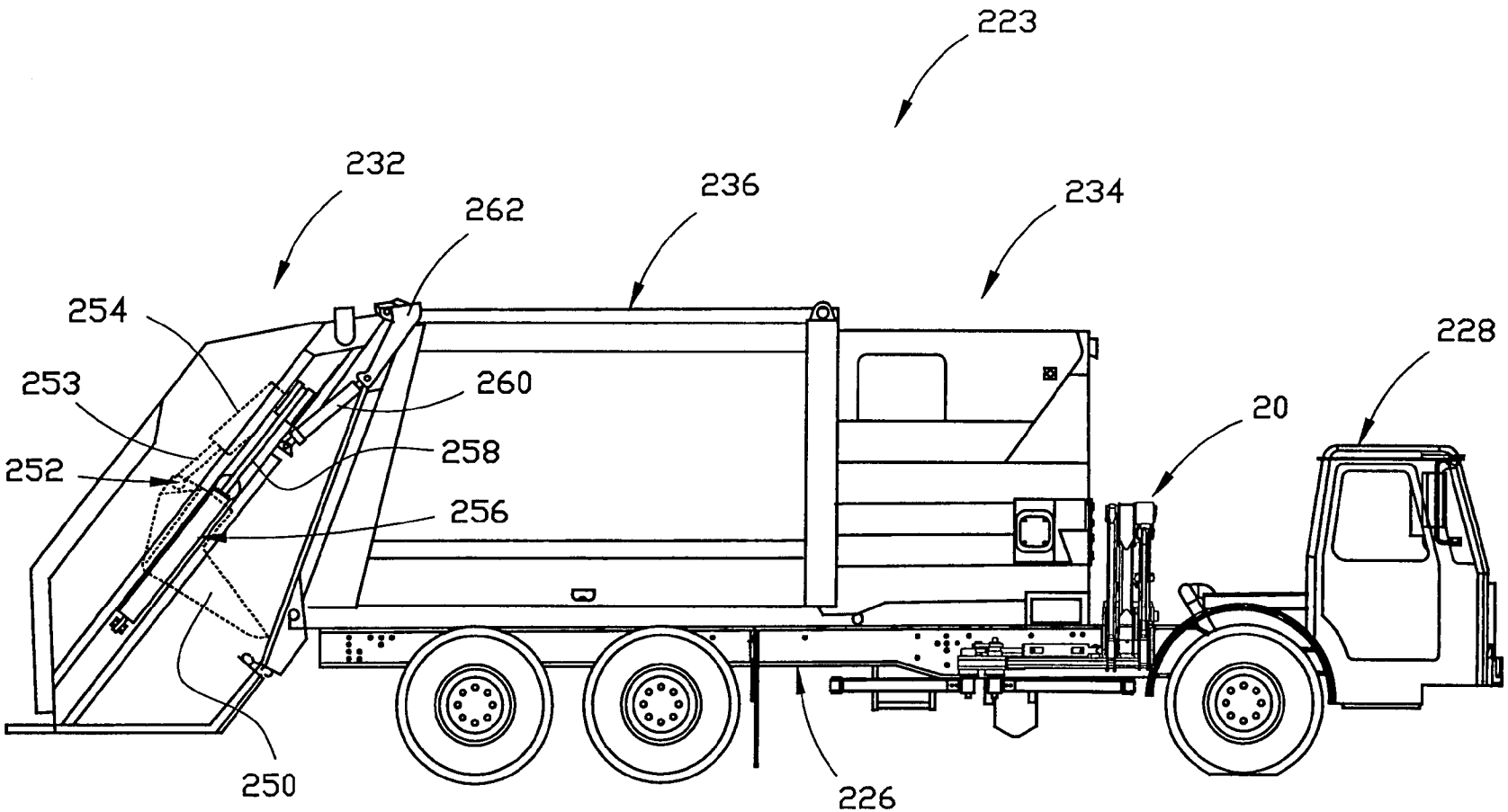
FIG. 2B is a side view of a first alternative vehicle to that of FIGS. 1 and 2A.

The invention may also be used in connection with a refuse collection vehicle having a rear-mounted collection assembly that is employed to receive refuse from containers dumped into a rear collection compartment and to move such refuse into a storage compartment on the vehicle. Thus, for example, FIG. 2B illustrates vehicle 223 having a rear collection compartment 232 and a front collection bin 234. Between the two collection compartments is located a storage compartment 236. Apparatus 20 is mounted onto the frame 226 of vehicle 223 behind cab 228 and adapted to empty the contents of a container (such as container 24 of FIG. 2A) into collection bin 234. A compaction ram (not shown) is preferably provided at the front of collection bin 234 and is adapted to move refuse material into storage compartment 238 and to compact it therein. Rear collection compartment 232 is provided with packer blade 250, which is pivotally mounted at pivot 252 to fluid-operated actuator 254. Retraction of rod 253 of actuator 254 causes the packer blade to open up (not shown) to permit material to be dumped into the collection compartment. Then rod 253 is extended (as shown in FIG. 2B) and a pair of actuators 256 (only one of which is shown), which are mounted on opposite sides of the collection compartment, may be actuated to move the packer blade upwardly in the collection compartment by retraction of rods 258 (only one of which is shown). This action sweeps refuse material from collection compartment 232 into storage compartment 236. Other means including various fluid-operated actuators and linkage components are also known for moving the packer blade so as to move material from the collection compartment into the storage compartment, and these are contemplated as being included within the scope of the invention described and claimed herein. When it is desired to eject material from storage compartment 236, fluid-operated actuator 260 is actuated to tilt the collection compartment 232 about pivot 262, and the compaction ram (not shown) located at the front of collection bin 234 may be actuated to push material out of the storage compartment and out of vehicle 223.

Figure 2C:
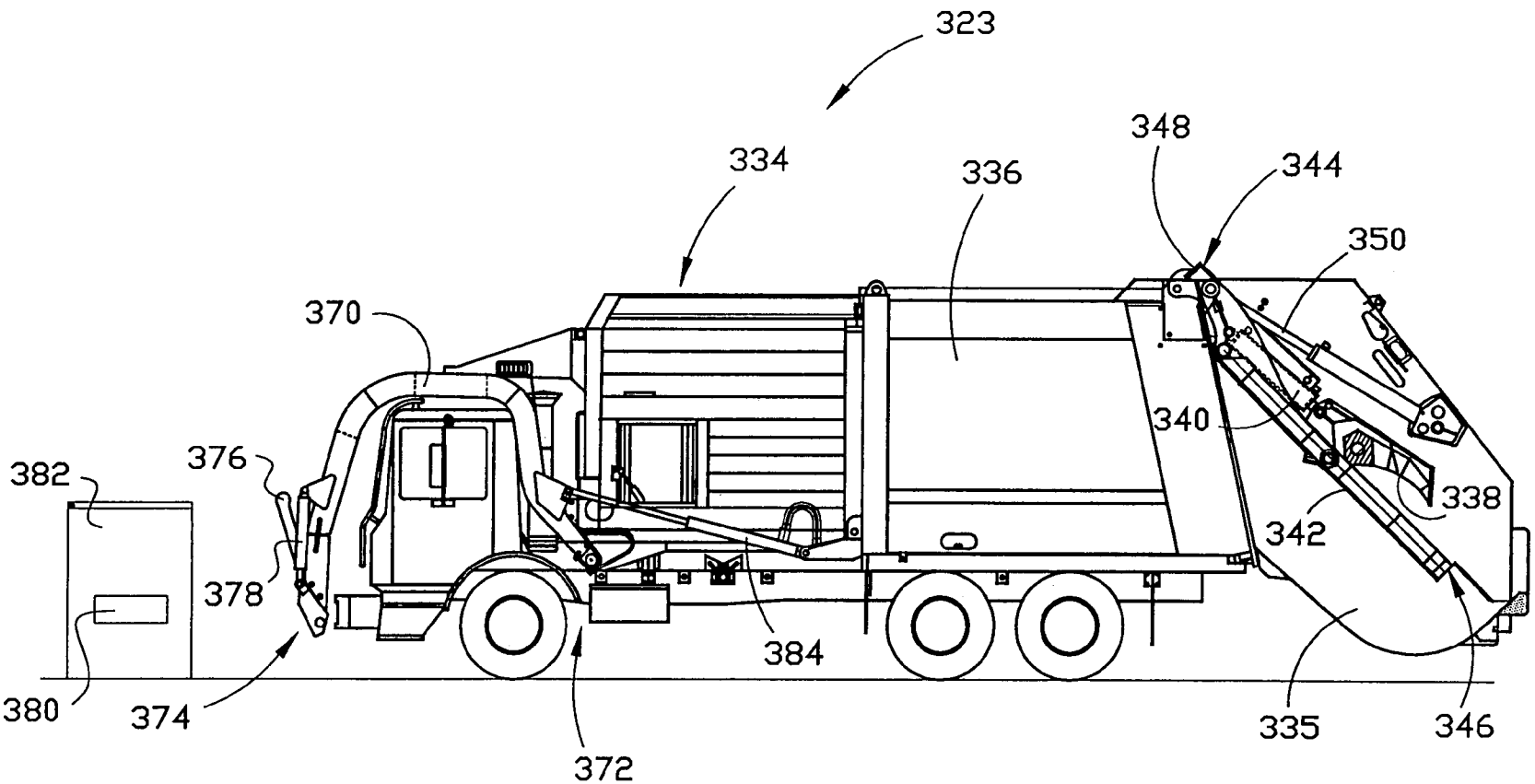
FIG. 2C is a side view of a second alternative vehicle to that of FIGS. 1 and 2A.
Figure 3:
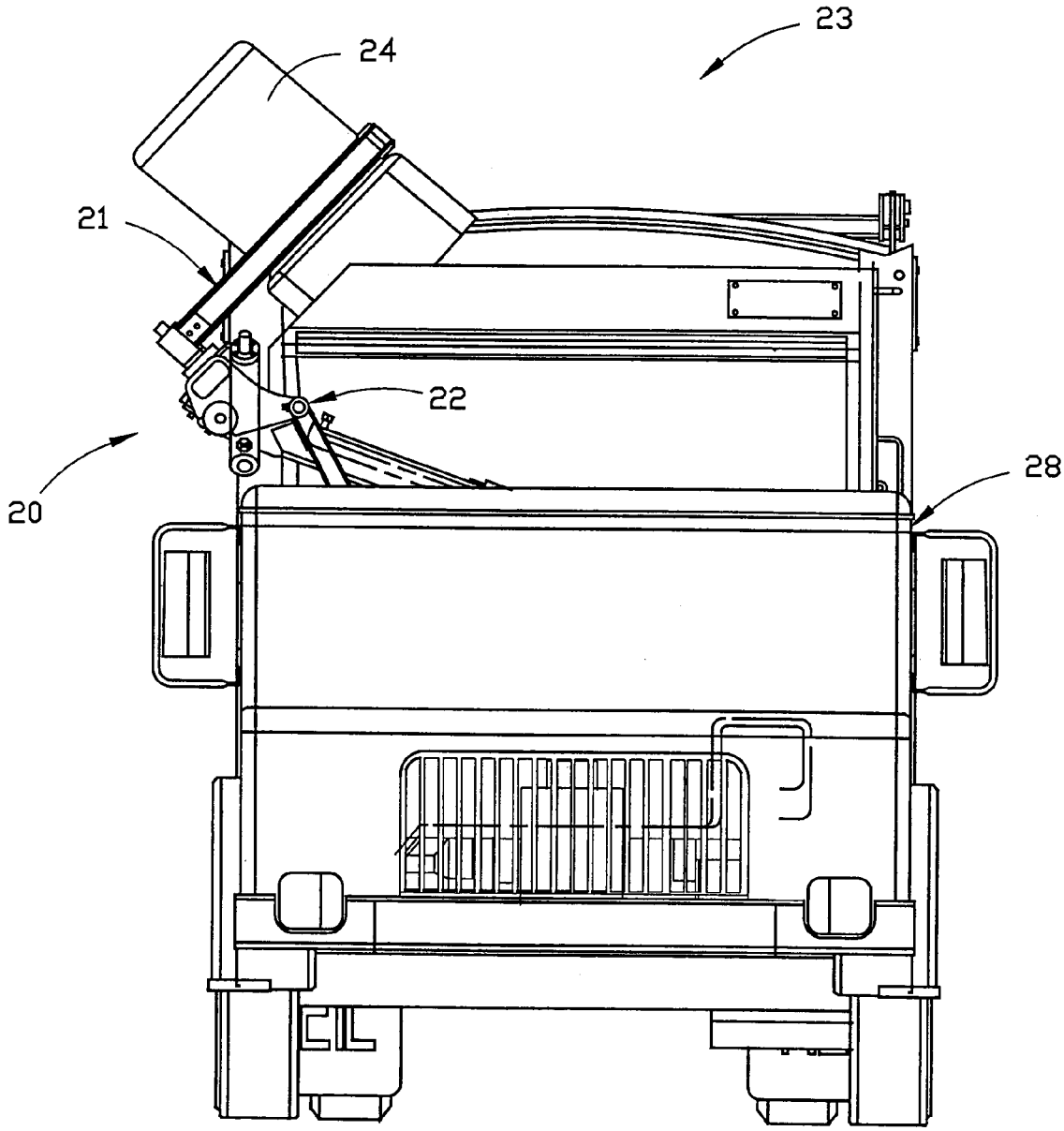
FIG. 3 is a front view of the vehicle of FIGS. 1 and 2A.

It is also contemplated that a vehicle may be provided having a rear-mounted collection assembly and a front-mounted container-lifting assembly. Thus, for example, FIG. 2C illustrates a vehicle 323 having, in combination, a rear-mounted collection assembly and a front-mounted container-lifting assembly. As shown in FIG. 2C, vehicle 323 is provided a front collection bin 334 and a rear-mounted collection assembly which includes collection compartment 335. Between the two collection compartments is located a storage compartment 336. Rear collection compartment 335 is provided with packer blade 338, which is pivotally mounted to fluid-operated packer blade actuator 340. Each of a pair of tracks 342 (only one of which is shown) includes an upper end 344 and a lower end 346. A shoe 348 (located at the upper end of track 342 in FIG. 2C) is pivotally attached to fluid-operated packer shoe actuator 350. Refuse may be place in compartment 336 when packer blade 338 is in the open position, and packer shoe 348 is at the upper end 344 of track 342, as illustrated in FIG. 2C. Packer blade actuator 340 is in a retracted condition when the packer blade is in the open position, and packer shoe actuator 350 is in an extended condition when the packer shoe is at the upper end of the track. After refuse is placed in the compartment, the packer shoe actuator retracts so as to move packer shoe 348 to lower end 346 of track 342 (not shown). When the packer shoe reaches the lower end of the track, packer blade actuator 340 extends so as to move the packer blade from the open position to a closed position (also not shown). After the packer blade reaches the closed position, packer shoe actuator 350 extends so as to move packer shoe 348 towards upper end 344 of track 342. As the packer shoe moves towards the upper end of track 342, the packer blade lifts the refuse from compartment 335 into storage compartment 336. After the packer shoe reaches the upper end of the track, the packer blade may be moved from the closed position to the open position by retraction of the packer blade actuator. The hopper is now ready to receive refuse again, and the cycle described above may be repeated until the storage compartment is fully loaded with refuse.

The front mounted container lifting assembly of vehicle 323 is comprised of a pair of lifting arms 370 (only one of which is shown) having a first end 372 and a second end 374. First end of 372 of each lifting arm is pivotally mounted onto vehicle frame 326. A pair of associated forks 376 (only one of which is shown) are also provided, one of which is pivotally attached to the second end of each lifting arm. The container-lifting assembly also includes a pair of fluid-operated actuators 378 (only one of which is shown) which may be extended to pivot the forks about the ends of the lifting arms in order to engage the sleeves 380 on a container such as container 382. The container-lifting assembly also includes a pair of fluid-operated actuators 384 (only one of which is shown) which may be actuated to raise and lower arms 370 between the lowered position shown in FIG. 2C to a position (not shown) in which the contents of the container may be dumped in collection bin 334.

Figure 5:
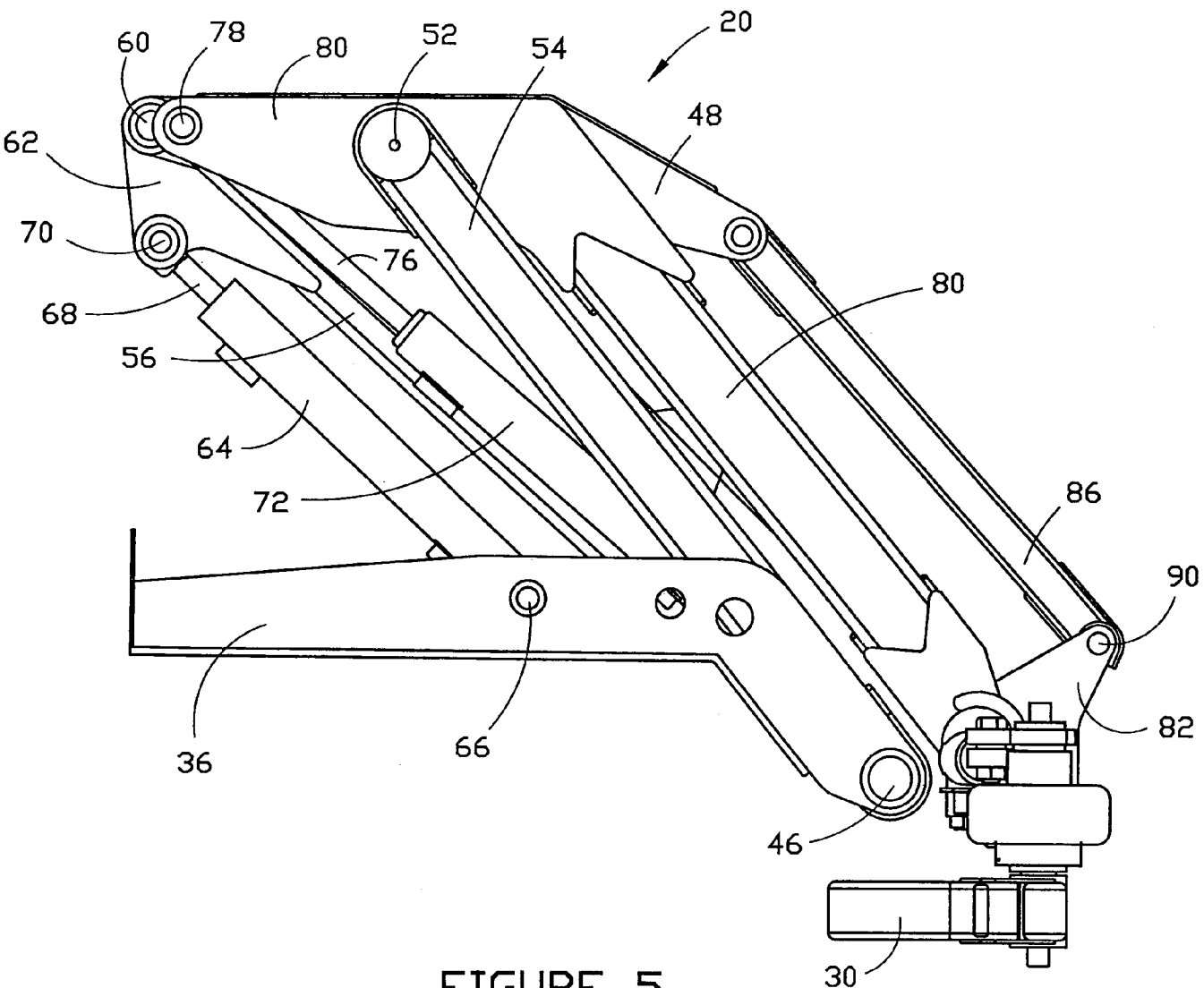
FIG. 5 is a right side view of the invention, shown in the retracted position.
Figure 6:
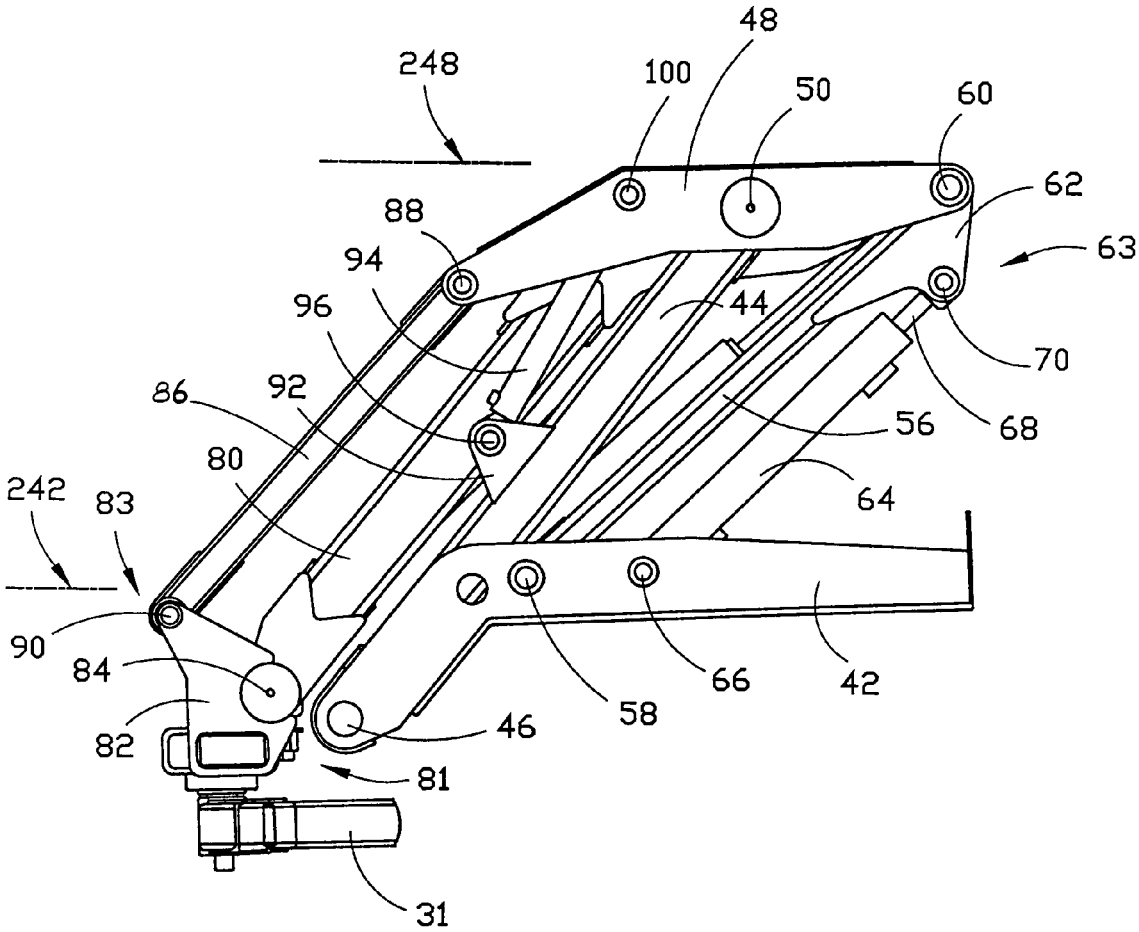
FIG. 6 is a left side view of the apparatus of FIG. 5.

FIG. 5 shows the right side of apparatus 20 in the retracted position, and FIG. 6 shows the left side. The preferred arm apparatus comprises various mechanical components and a fluid-operated actuating system which includes a pair of primary hydraulic actuators (sometimes referred to herein as hydraulic cylinders or cylinders). Preferably, the arm apparatus includes a base that is comprised of a series of parallel components, including right base link 36, first intermediate base link 38, second intermediate base link 40 and left base link 42 (see FIG. 12). The preferred base is adapted to be mounted onto the frame of a vehicle such as vehicle 23. The invention also contemplates that some of the other members of arm apparatus 22 may be comprised of parallel or paired components, such as, for example, left reach link 44 and right reach link 54. It is also contemplated that each of these parallel (or paired) components of the preferred embodiment may be replaced by a single component, such as a single base link and a single reach link.

Each of the links of the preferred arm apparatus has a first end and a second end. As illustrated in the drawings, the first end of each of base links 36, 38, 40 and 42, and the first end of upper link 48 is considered to be the end nearest the container, and the second end is considered to be the end nearest to the center of the vehicle. By a similar convention, the first end of reach links 44 and 54, secondary reach link 56, lift arm 80 and grabber support arm 86 is considered to be the end nearest the base link, or the lower end. The second end of each of the reach links, secondary reach link, lift arm and grabber support arm is the end furthest from the base link, or the upper end. Thus, in the preferred embodiment of the invention that it illustrated in FIG. 6, the first end of left reach link 44 (see FIG. 6) is pivotally attached at pivot 46 to the first end of each of base link components 40 and 42, and the second end of left reach link 44 is pivotally attached to upper link 48 at pivot 50 (located at a second intermediate position between the first end and the second end of the upper link). Similarly, as shown in FIG. 5, the first end of right reach link 54 (which is parallel to left reach link 44) is pivotally attached at pivot 46 to the first end of each of base link components 36 and 38, and the second end of right reach link 54 is pivotally attached to lift arm 80 at pivot 52 (located at an intermediate position between the first end and the second end of the lift arm). Referring again to FIG. 6, the first end of secondary reach link 56 is pivotally attached to base link components 40 and 42 at pivot 58 (located at an intermediate position between the first end and the second end of base link components 40 and 42), and the second end of secondary reach link 56 is pivotally attached at pivot 60 to the second end of upper link 48. Clevis link 62 is preferably attached to and forms an extension of the second end of secondary reach link 56. In the alternative (not shown), clevis 62 could be attached to the second end of upper link 48, thereby forming an extension of such upper link.

Arm assembly 22 includes a fluid-operated actuating system having two primary hydraulic actuators, reach actuator 64 and lift actuator 72. The base of reach actuator 64 is preferably pivotally attached at pivot 66 to the second end of base link components 40 and 42, and rod 68 of actuator 64 is preferably pivotally attached at pivot 70 to the lower (or first) end 63 of clevis link 62. In the alternative (not shown), clevis link 62 may be eliminated, and rod 68 of actuator 64 may be pivotally attached to the second end of upper link 48. The base of lift actuator 72 is preferably pivotally attached to base link components 38 and 40 at pivot 74 (see FIG. 11), located at an intermediate position between the first end and the second end of the base link components. Rod 76 of actuator 72 is preferably pivotally attached at pivot 78 (see FIG. 5) to the second end of lift arm 80. It is also contemplated that the attachments of the bases and rods of the reach and lift actuators could be reversed. In other words, for example, the base of reach actuator 64 may be pivotally attached at pivot 70 to the lower (or first) end 63 of clevis link 62, and rod 68 of actuator 64 may then be pivotally attached at pivot 66 to the second end of base link components 40 and 42.

As shown in FIG. 6, the lower (or first) end of lift arm 80 is pivotally attached to the lower (or first) end 81 of grab link 82 of the grab assembly at pivot 84. The first end of grabber support arm 86 is pivotally attached to the upper (or second) end 83 of grab link 82 at pivot 90, and the second end of grabber support arm 86 is pivotally attached at pivot 88 to the first end of upper link 48.

A slave actuator or cylinder is preferably included in the arm assembly of the invention in order to provide better control during the operating cycle. Thus, as shown in the drawings, clevis 92 is attached to left reach link 44, and the base of slave actuator 94 is pivotally attached to clevis 92 at pivot 96. Rod 98 of actuator 94 is pivotally attached to upper link 48 at a first intermediate position, pivot 100, between the first end and the second intermediate position (at pivot 50) of upper link 48.

Figure 7:
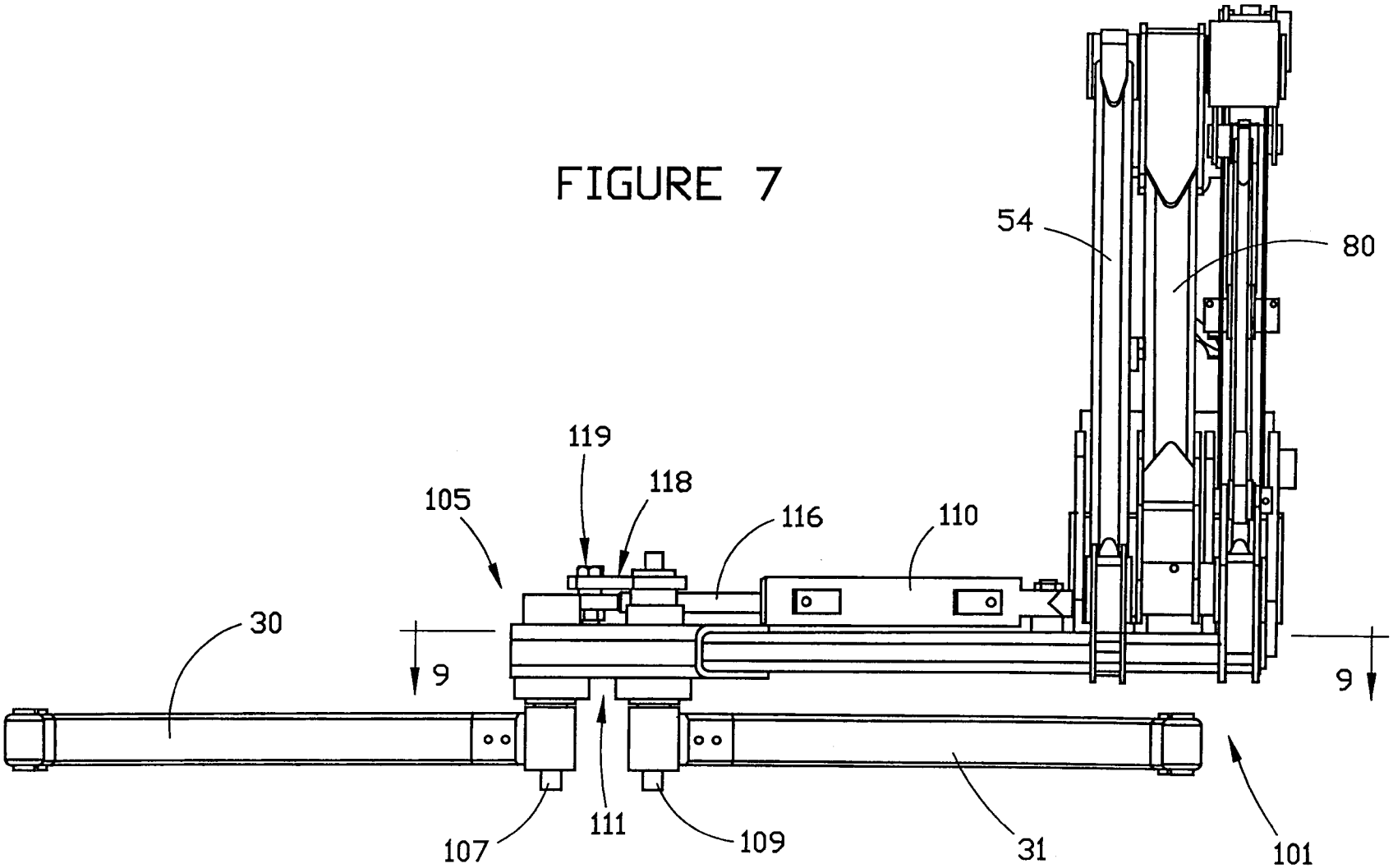
FIG. 7 is a front view of the apparatus of FIGS. 5 and 6.
Figure 9:
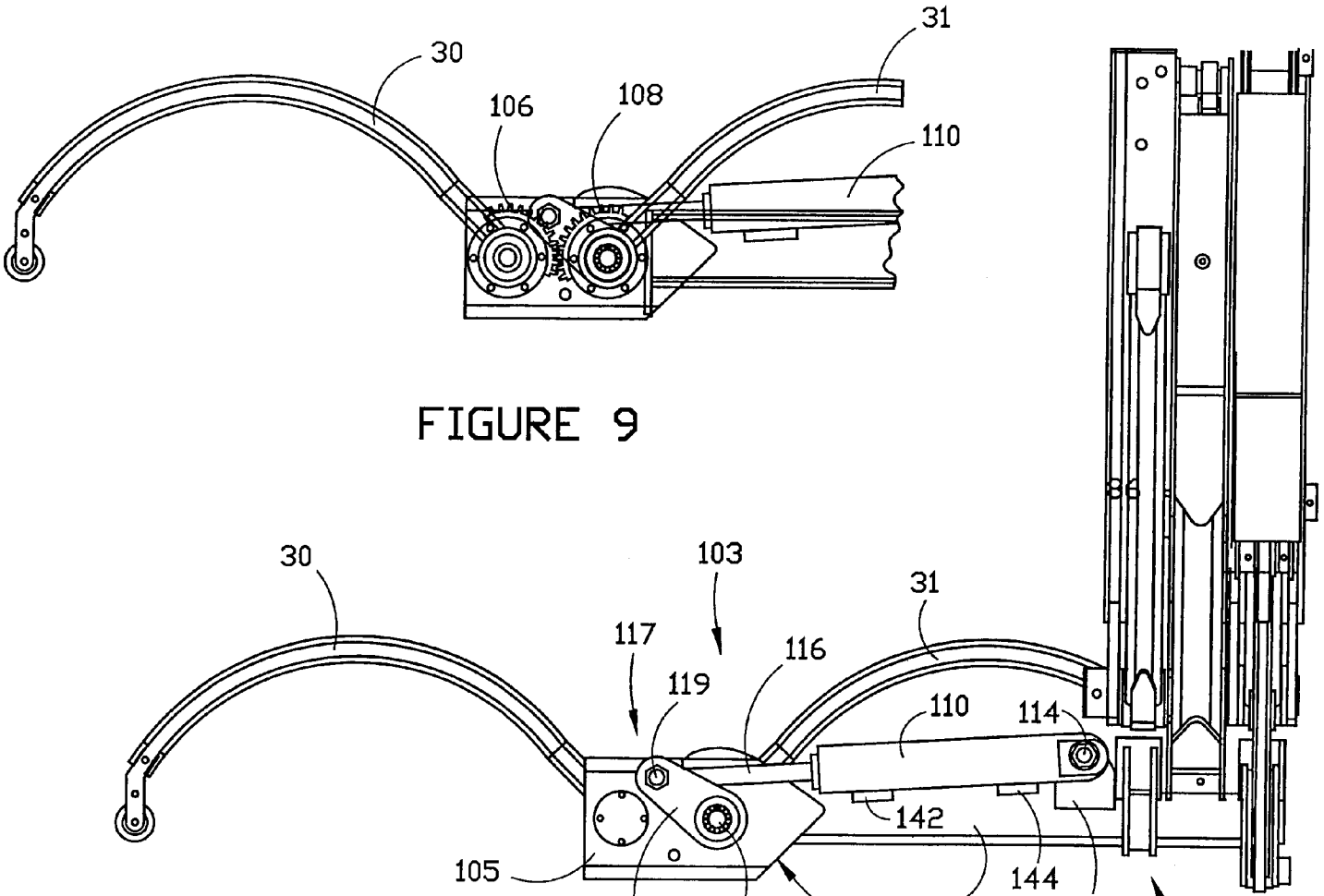
FIG. 9 is a partial sectional view of a portion of the apparatus of FIGS. 5 through 8, as taken through line 9—9 of FIG. 7.
Figure 8:
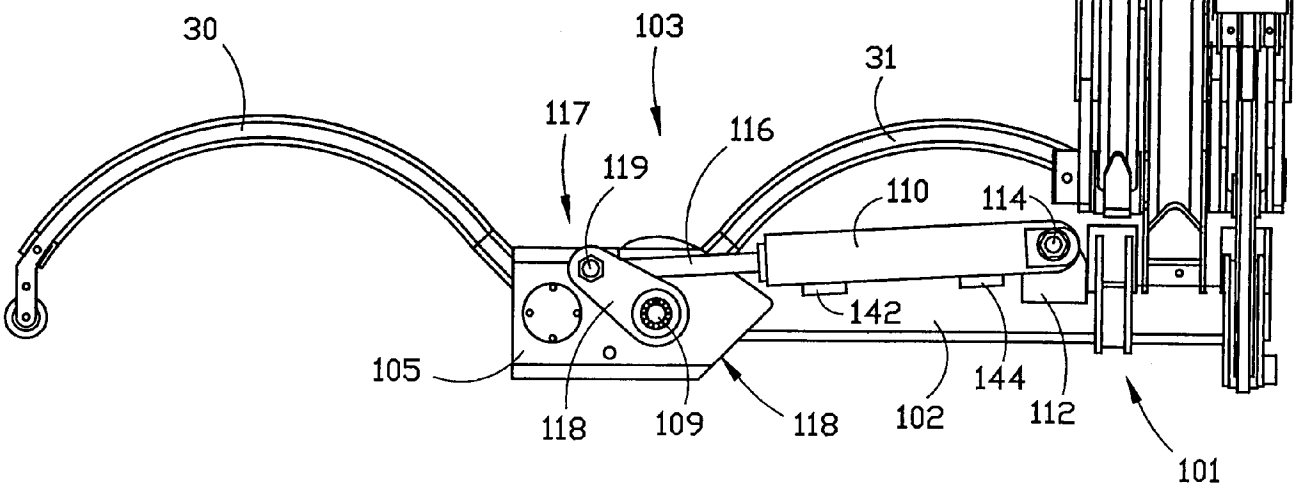
FIG. 8 is a top view of the apparatus of FIGS. 5 through 7.

As has been mentioned, preferred apparatus 20 includes container grab assembly 21 which is provided with a pair of grabbing arms 30 and 31 and a fluid-operated actuating system. First end 101 of side support arm 102 (see FIGS. 8 and 9) of grab assembly 21 is attached to the lower end of grab link 82 (see FIG. 5) of arm assembly 22. Second end 103 of side support arm 102 is attached to gear box 104. Right gear 106 (see FIG. 9) is attached to grabbing arm 30 and both are mounted on right shaft 107 (see FIG. 7); left gear 108 is attached to grabbing arm 31 and both are mounted on left shaft 109. Gears 106 and 108 are meshed together within enclosed gear box 104. Preferably, a suitable lubricant is provided in the gear box to further protect the gears. As shown in FIGS. 7 and 8, the gear box has a first (or upper) side 105 and a second (or lower) side 111. Left shaft extends through both first side 105 and second side 111 of gear box 104; however, right shaft 107 extends through only the second side 111 of the gear box. The base of grabber actuator or cylinder 110 is pivotally attached to clevis 112 at pivot 114, and clevis 112 is mounted on side support arm 102. Rod 116 of cylinder 110 is pivotally attached to second end 117 of drive link 118 at pivot 119 on top of gear box 104. First end 120 of the drive link is attached to shaft 109, so that retraction of rod 116 into cylinder 110 from the position shown in FIG. 8 will cause drive link 118 to pivot to the right (as viewed in FIG. 8) about a pivot axis through shaft 109 causing grabbing arms 30 and 31 to close from the position illustrated in FIG. 8 to the grab position illustrated in FIG. 12.

Figure 10:
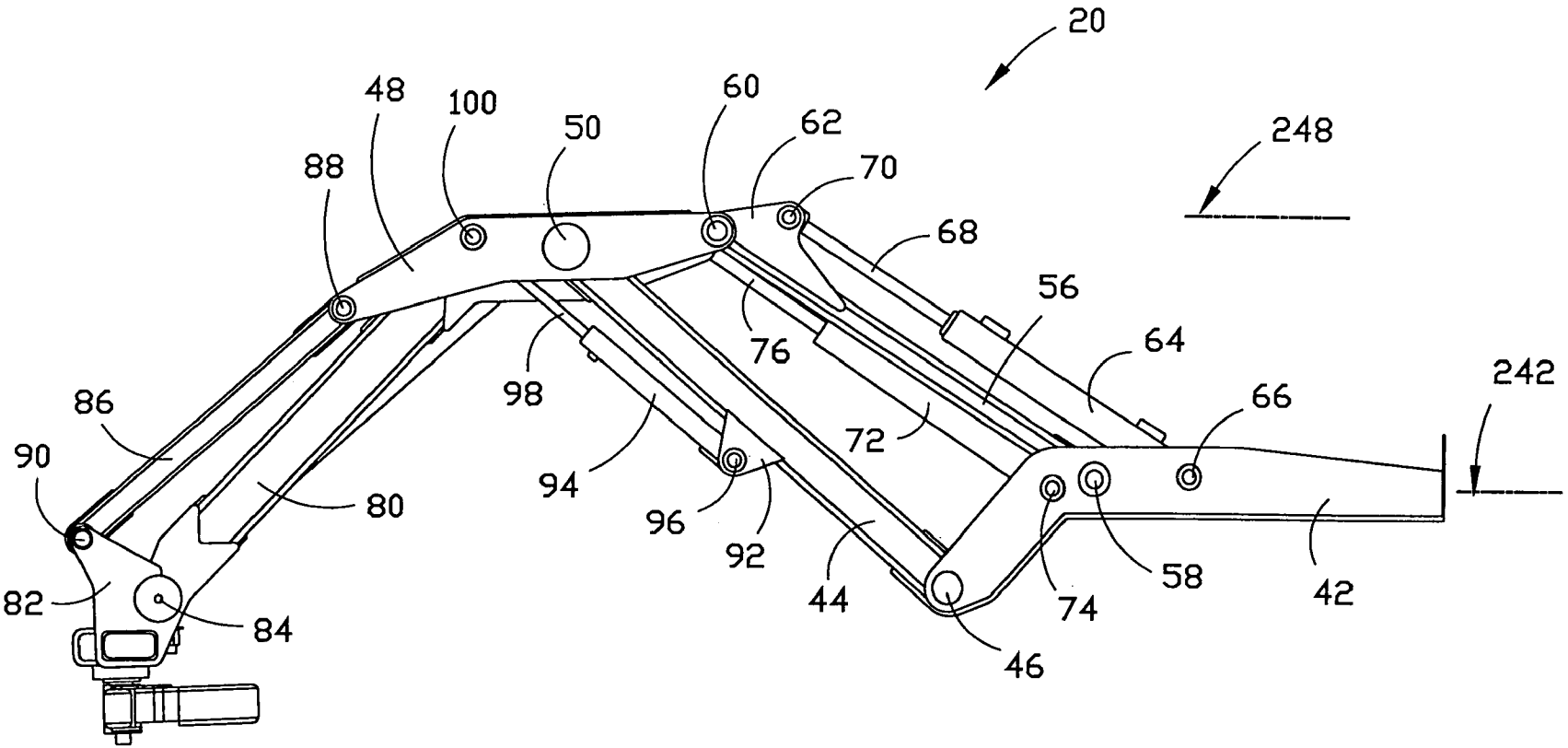
FIG. 10 is a side view of the invention shown in the reach position.
Figure 11:
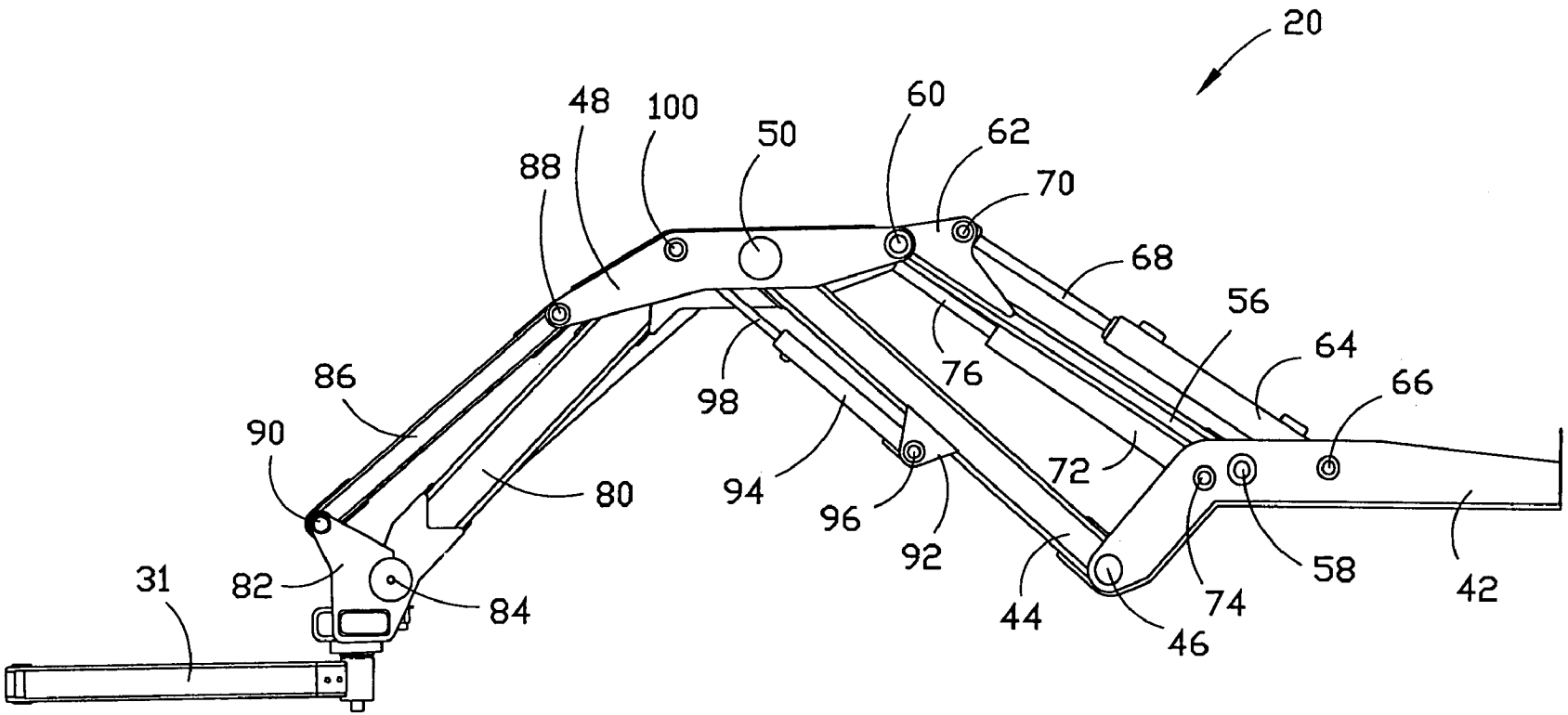
FIG. 11 is a side view of the invention shown in the grab position.
Figure 12:
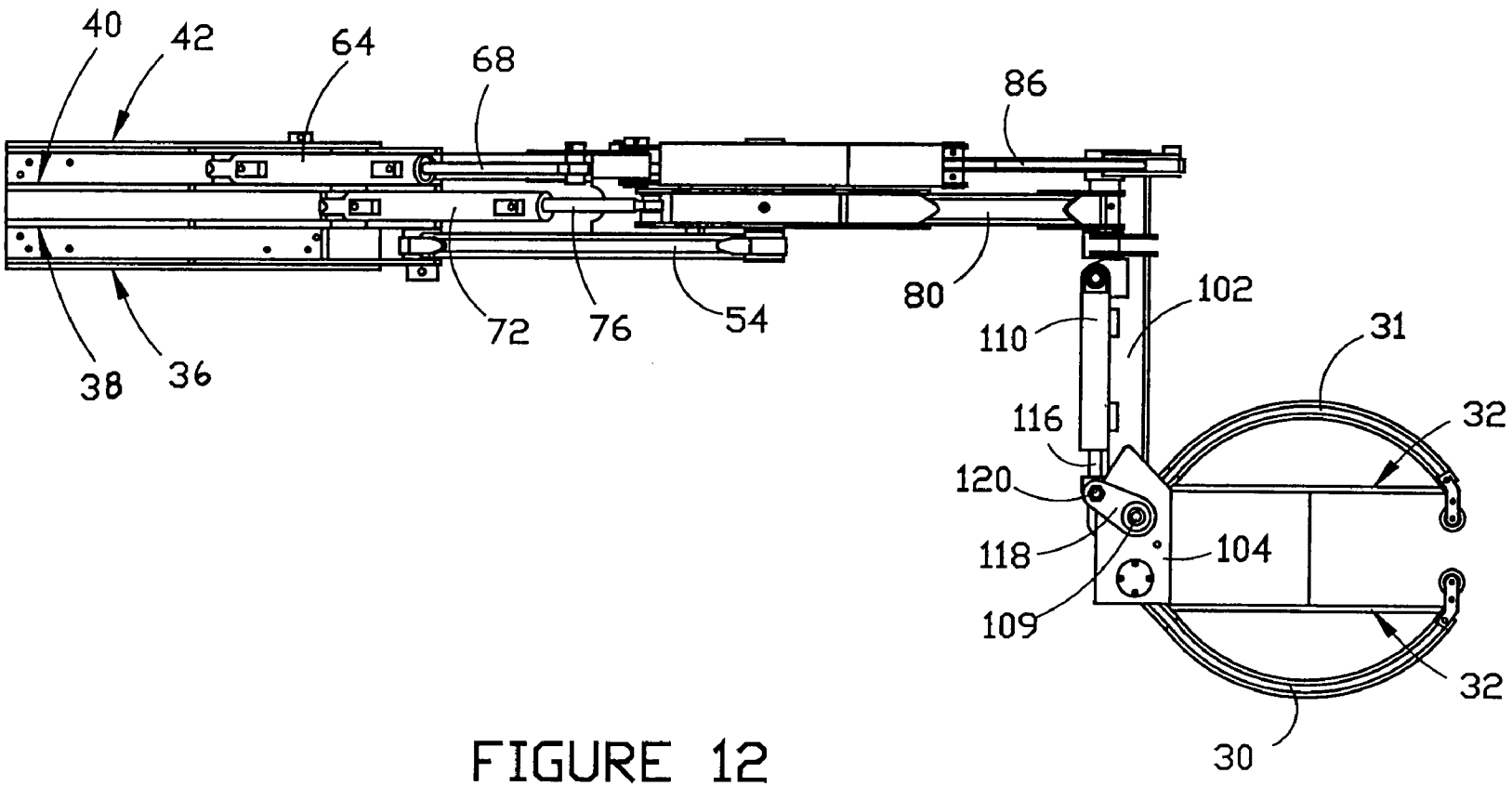
FIG. 12 is a top view of the apparatus of FIG. 11.
Figure 13:
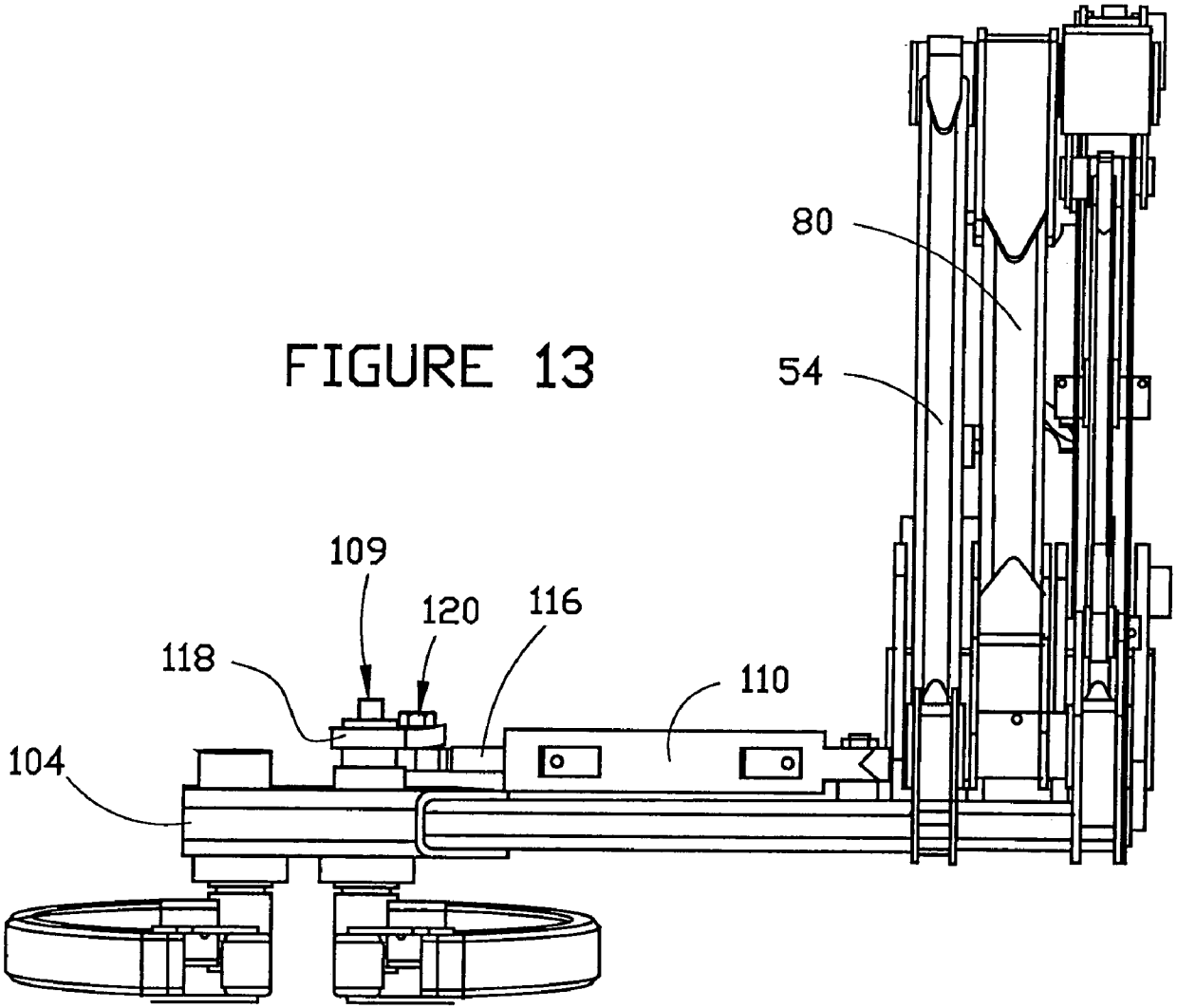
FIG. 13 is a front view of the apparatus of FIGS. 11 and 12.
Figure 14:
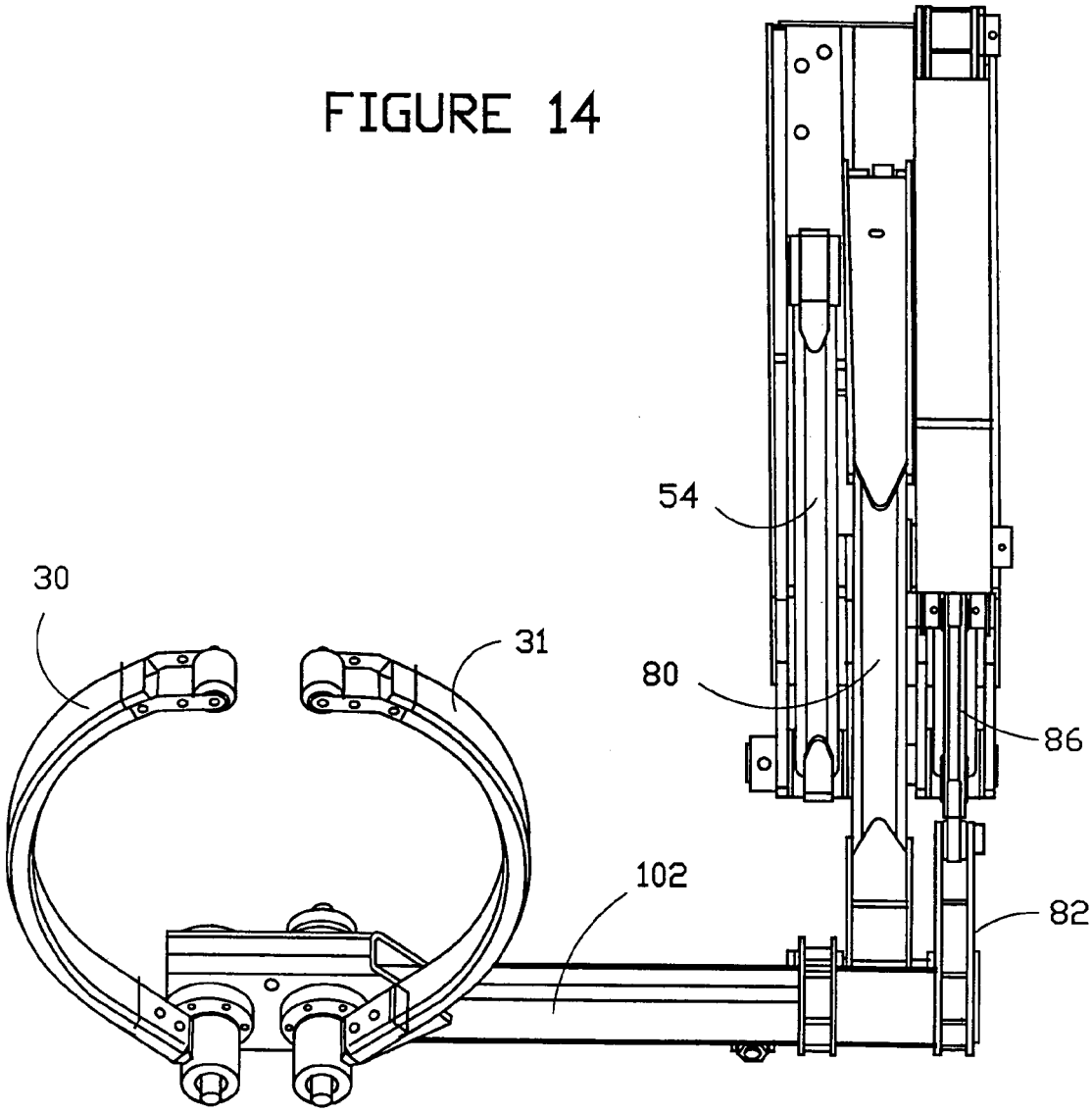
FIG. 14 is a front view of the invention as it begins to raise the container.
Figure 15:
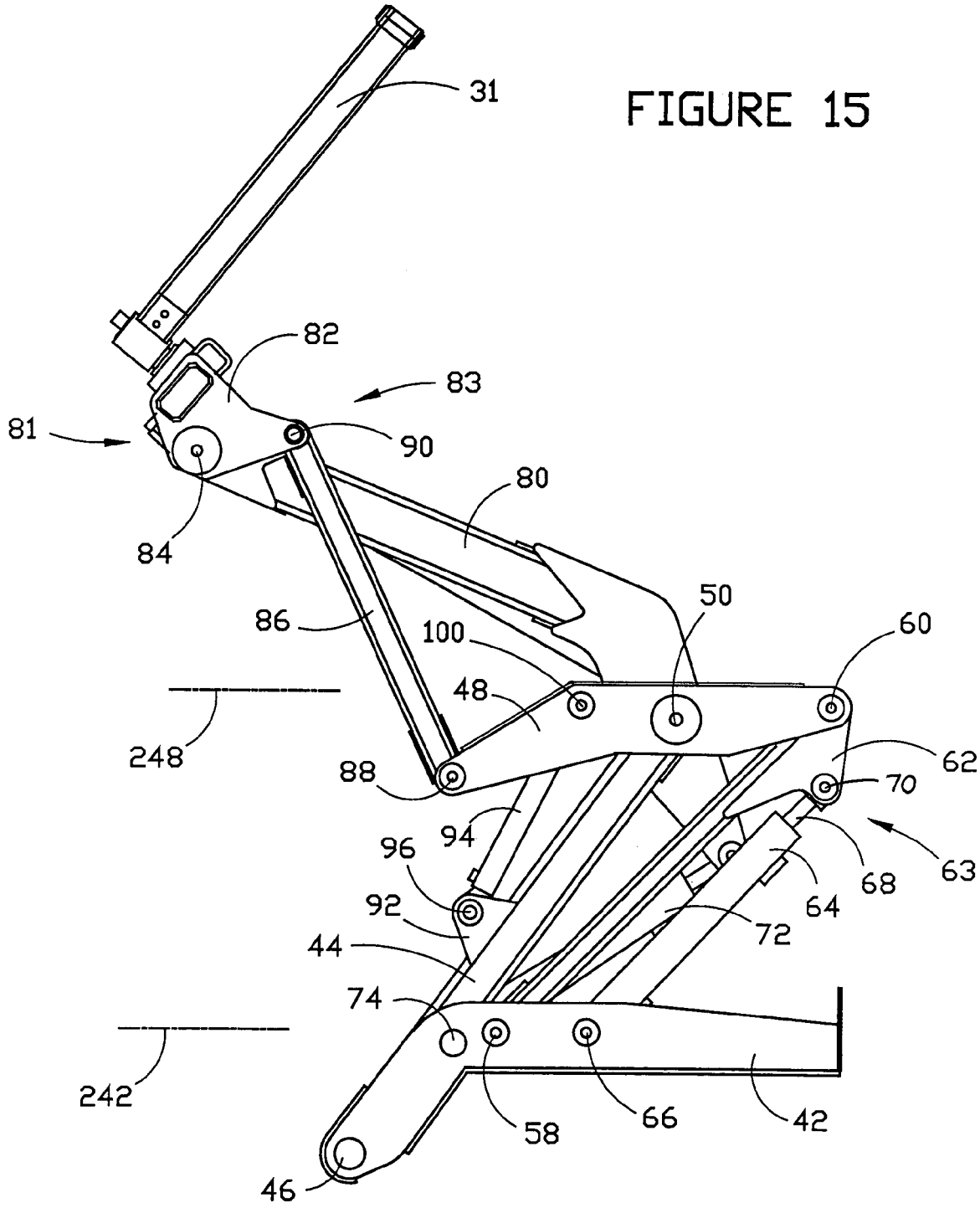
FIG. 15 is a side view of the invention shown in the dump position.
Figure 16:
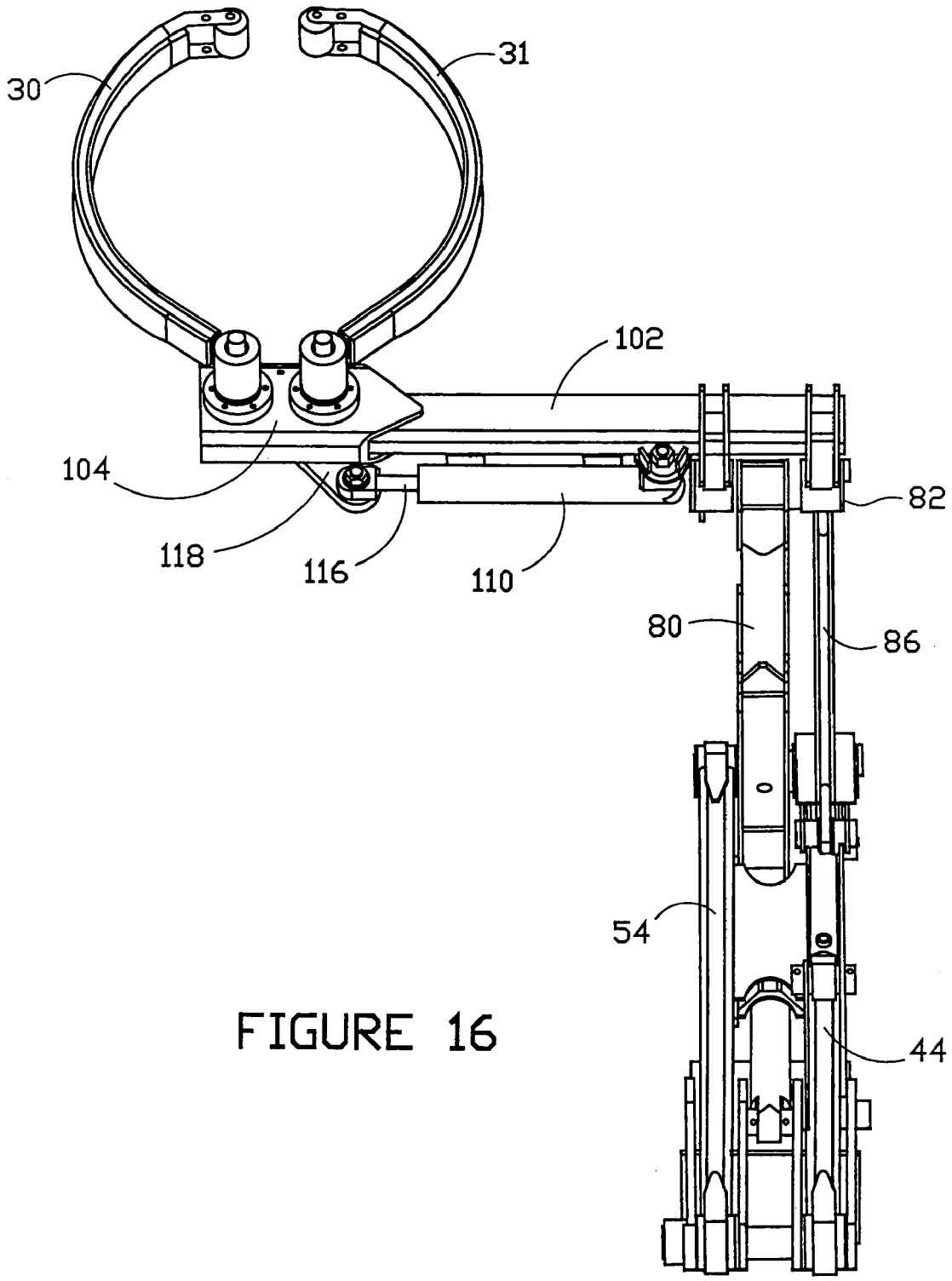
FIG. 16 is a front view of the apparatus of FIG. 15.

By examining the drawings of apparatus 20 in a sequential manner from the retracted position of FIGS. 5 through 8 to the reach position of FIG. 10, the grab position of FIGS. 11 through 13, the lift position of FIG. 14 and the dump position of FIGS. 15 and 16, and then reversing the sequence back to the retracted position, the interrelationship of the various linkage components can be appreciated. The base link, upper link, reach link and lift arm are arranged and interconnected so that the upper link remains generally parallel to the base link throughout the operating cycle. As an examination of FIGS. 6, 10 and 15 will reveal, axis 248 through pivots 60 and 100 of the upper link remains parallel, or within about 20° of parallel, to axis 242 through pivots 58 and 66 of the base link throughout the operating cycle.

Figure 17:
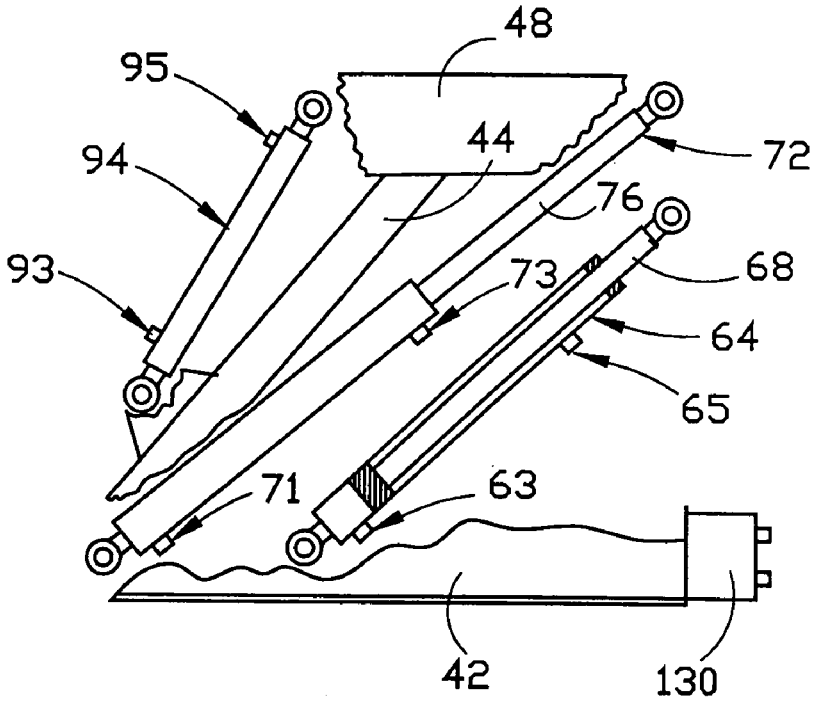
FIG. 17 is a left side partial sectional view of a portion of the invention, similar to the view of FIG. 6, showing some of the components of the invention in the retracted position.
Figure 18:
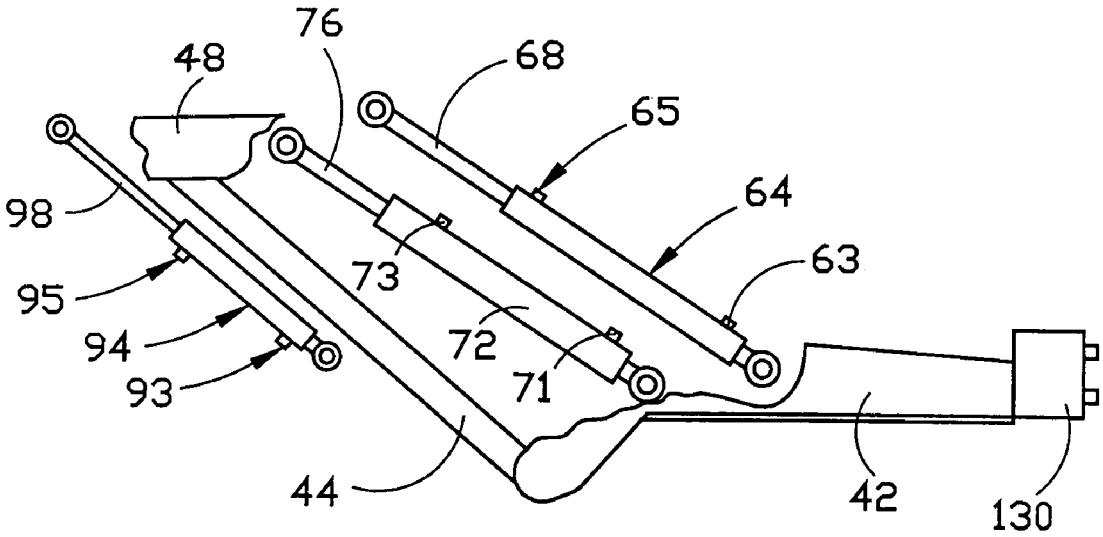
FIG. 18 is a left side view of a portion of the invention, similar to the view of FIG. 10, showing some of the components of the invention in the reach or the extended position.
Figure 19A:
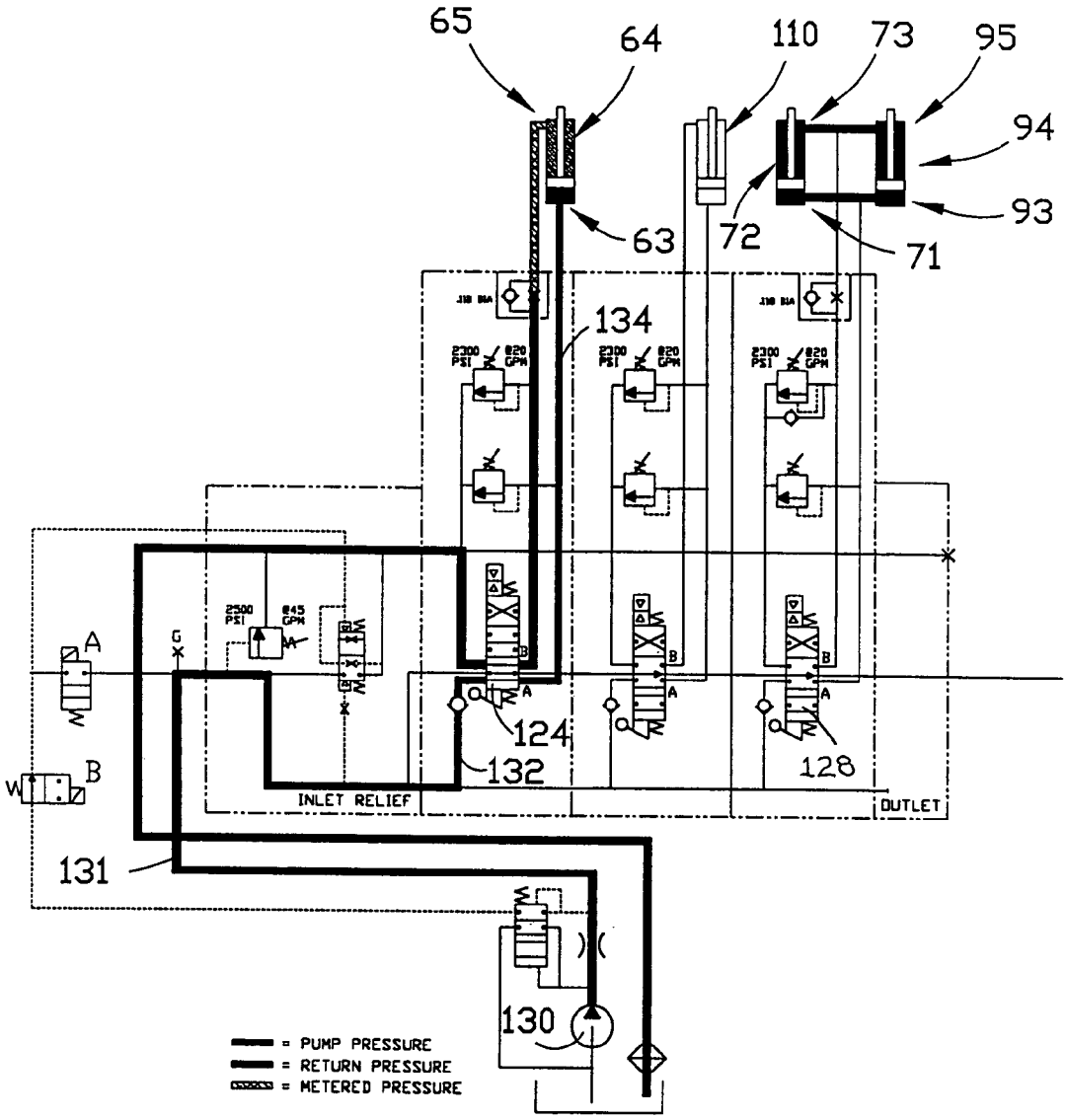
FIG. 19A is a schematic hydraulic circuit diagram showing the operation of the fluid-operated actuating systems of the container grab assembly and the arm assembly of the invention during the "extend" portion of the preferred operating cycle.
Figure 19B:
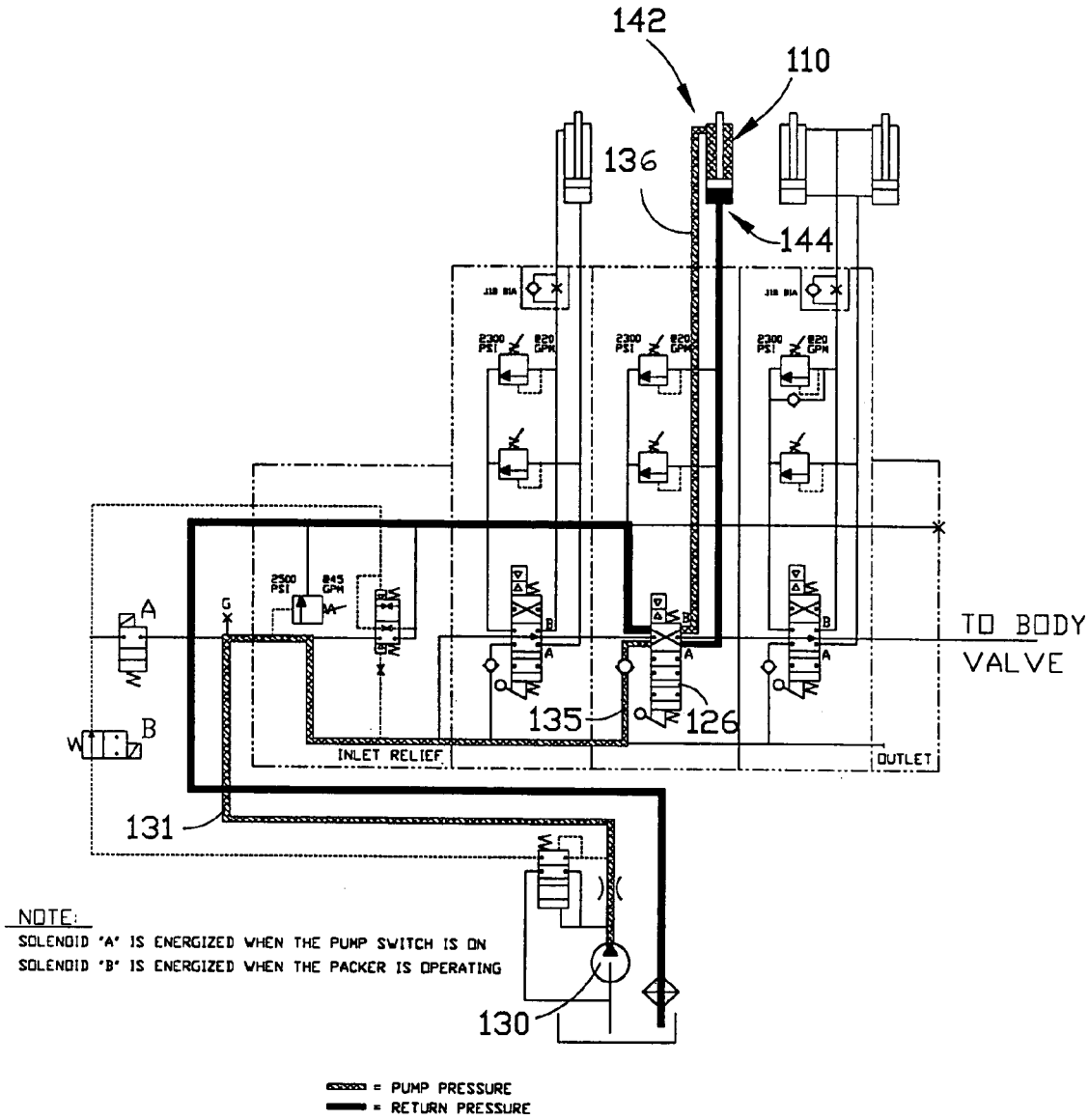
FIG. 19B is a schematic hydraulic circuit diagram showing the operation of the fluid-operated actuating systems of the container grab assembly and the arm assembly of the invention during the "grab" portion of the preferred operating cycle.
Figure 19C:
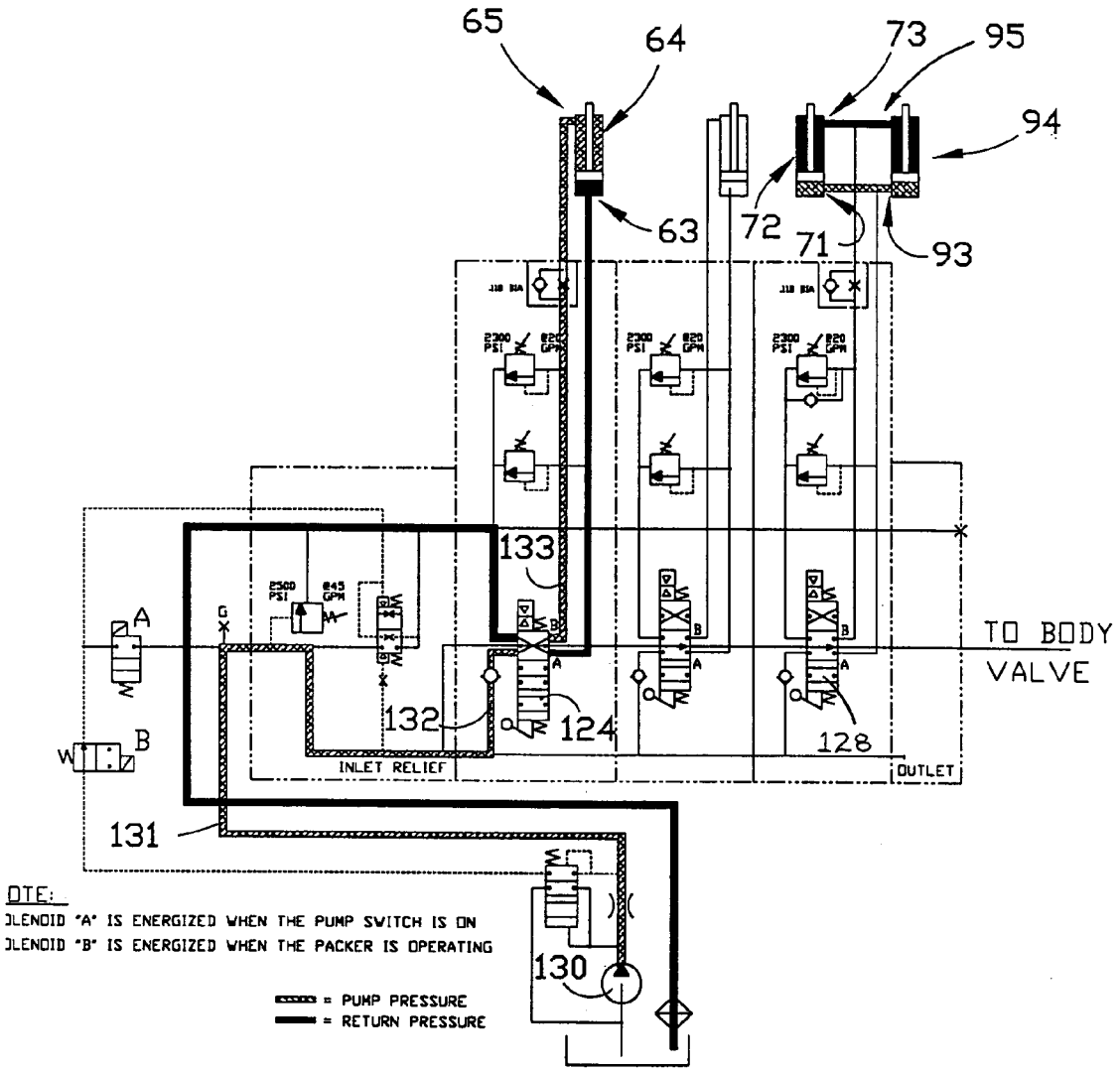
FIG. 19C is a schematic hydraulic circuit diagram showing the operation of the fluid-operated actuating systems of the container grab assembly and the arm assembly of the invention during the "retract" portion of the preferred operating cycle.
Figure 19D:
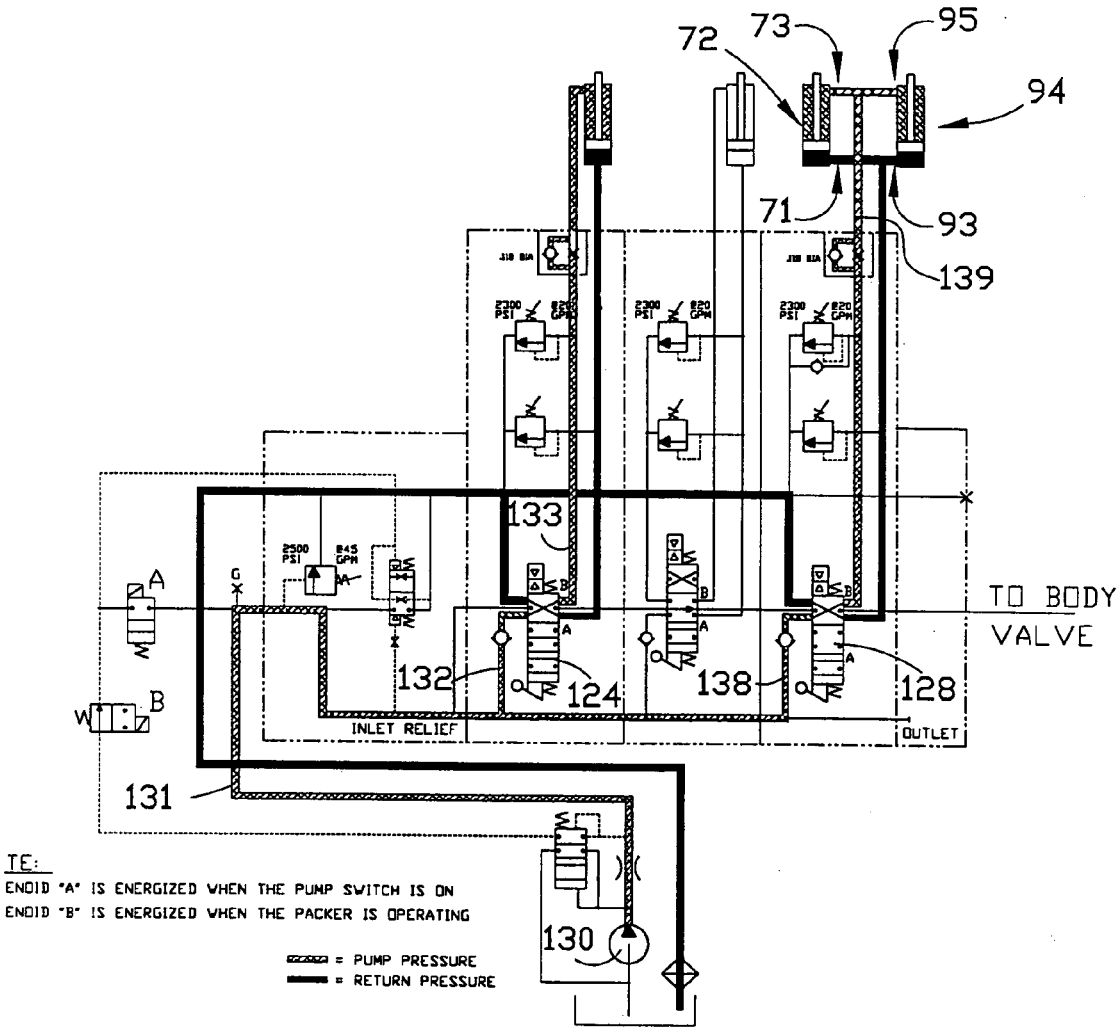
FIG. 19D is a schematic hydraulic circuit diagram showing the operation of the fluid-operated actuating systems of the container grab assembly and the arm assembly of the invention during the "dump" portion of the preferred operating cycle.
Figure 19E:
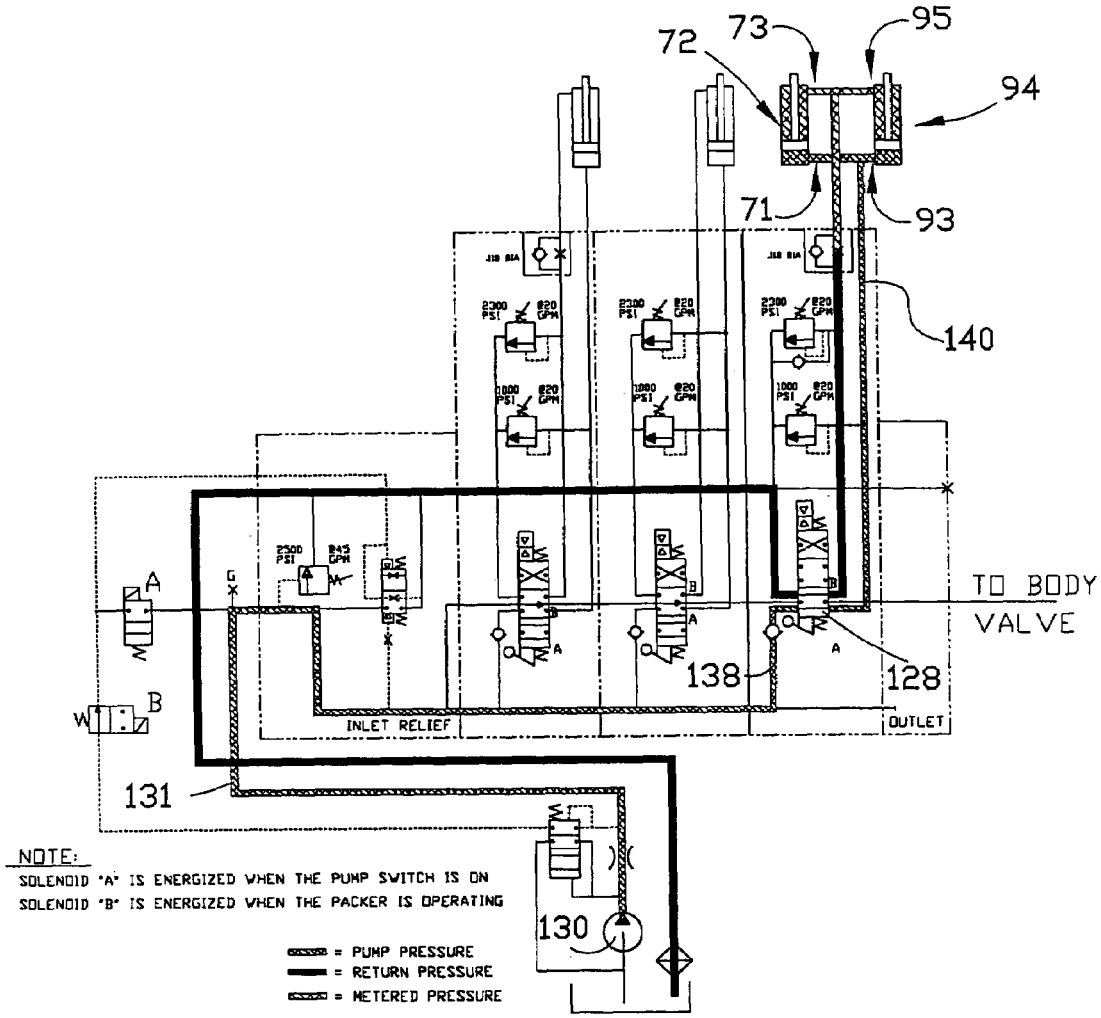
FIG. 19E is a schematic hydraulic circuit diagram showing the operation of the fluid-operated actuating systems of the container grab assembly and the arm assembly of the invention during the "lower" portion of the preferred operating cycle.
Figure 19F:
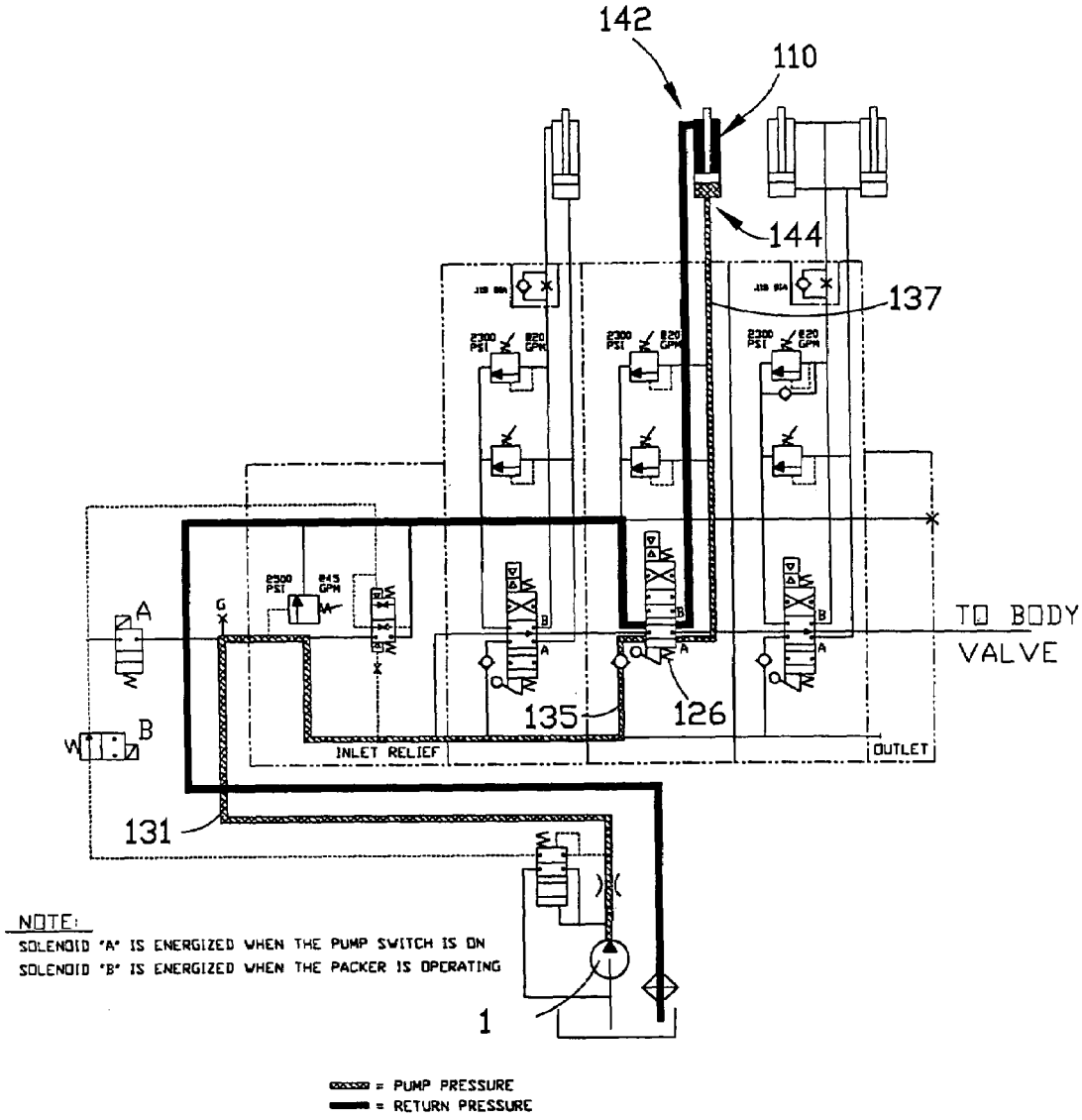
FIG. 19F is a schematic hydraulic circuit diagram showing the operation of the fluid-operated actuating systems of the container grab assembly and the arm assembly of the invention during the "release" portion of the preferred operating cycle.

FIGS. 17, 18 and 19A through 19F further illustrate the preferred hydraulic operating sequence of the invention through its operating cycle. As shown in FIG. 17, reach actuator 64, lift actuator 72 and preferred slave actuator 94, as well as left base member 42, upper link 48 and left reach link 44 are shown in the retracted position. The preferred operating sequence includes the "extend" step (FIG. 19A), the "grab" step (FIG. 19B), the "retract" step (FIG. 19C), the "dump" step (FIG. 19D), the "lower" step (FIG. 19E) and the "release" step (FIG. 19F). Referring now to FIG. 19A, to begin moving the invention through its operating cycle, the operator activates pump 130 and operates valve 124 to apply pump pressure to hydraulic fluid in lines 131, 132 and 134 to the extend side port 63 of reach actuator 64, while maintaining metered pressure on the retract side port 65 of the reach actuator and pump pressure on the retract side port 73 of lift actuator 72 and the retract side port 95 of slave cylinder 94. This action causes rod 68 of reach actuator 64 to extend, thereby moving apparatus 20 from the retracted position of FIG. 17 to the reach position of FIG. 18. As the apparatus is moved to the reach position, lift actuator 72 and slave actuator 94 will maintain the grabbing arms at a predetermined height, preferably the height that is suitable for grabbing a container located on the same elevation as vehicle 22. If the container is at an elevation above or below this predetermined level, the operator can adjust valve 128 to provide more or less lift through lift actuator 72 (as described hereinafter). The operator can also adjust the pump pressure applied to reach actuator 64 to provide more or less extension to adjust the distance from the vehicle to which the grabbing arms are extended. When the apparatus has been extended to the container, the operator can operate valve 126 to apply pump pressure to hydraulic fluid in lines 131, 135 and 136 to the retract side port 142 of actuator 110 (see FIGS. 8 and 19B) to close the opposed grabbing arms to acquire or grab the container. Then he may operate valve 124 to apply pump pressure to hydraulic fluid in lines 131, 132 and 133 to the retract side 65 of reach actuator 64, while maintaining pump pressure on the extend side 93 of slave actuator 94 and the extend side 71 of lift actuator 72 (see FIG. 19C) and operate valve 128 to apply pump pressure to hydraulic fluid in lines 131, 138 and 139 to the retract side 73 of lift actuator 72 and the retract side 95 of slave actuator 94 (see FIG. 19D). This action will cause the apparatus to move from the grab position of FIG. 13 through the lift position of FIG. 14 to the dump position of FIGS. 15 and 16. Then the operator may operate valve 128 to apply pump pressure to hydraulic fluid in lines 131, 138 and 140 to the extend side port 71 of lift actuator 72 and the extend side port 93 of slave actuator 94 (see FIG. 19E). This will return the container to a position at the predetermined level with respect to vehicle 22. Of course, by adjusting the opening of valve 124, the operator may adjust the elevation to which the container is moved to one that is higher or lower than that of the vehicle. The operator may then operate valve 126 to apply pump pressure to hydraulic fluid in lines 131, 135 and 137 to the extend side port 144 of actuator 110 (see FIGS. 8 and 19F) to open the grabbing arms to release the container. The operator may then operate valve 124 to apply pump pressure to hydraulic fluid in lines 131, 132 and 133 to the retract side port 65 of reach actuator 64 (see FIG. 19C). This action will move the apparatus to the retracted position of FIGS. 5 through 8.

The geometry of the various components, and the fact that actuators 64 and 72 are preferably operated from a single hydraulic pump 130 (see FIGS. 17, 18 and 19A through 19F) in parallel flow through at least a part of the operating cycle, allows the actuators to work together in balance as the various functions of the operating cycle are carried out. This permits effective, conventional cushioning at the ends of the stroke of each hydraulic actuator, thereby reducing vibrations and increasing the life cycle of the apparatus. By reducing vibrations, this unique linkage assembly also increases the comfort of the operator. In addition, the unique geometry of the linkage assembly permits a longer reach while maintaining an acceptably low profile in both the retracted position and the dumping position of the cycle. Furthermore, because of the balance obtained in the operation of the lift and reach actuators, the operator may complete the operating cycle more rapidly than with previously-known devices. The arm assembly of the apparatus is designed to balance the mass of the apparatus during the operating cycle while balancing actuation of the hydraulic actuators employed therein to allow for effective, conventional cushioning at the ends of the stroke of each hydraulic actuator. This unique articulate arm assembly, as well as the provision of parallel flow of hydraulic fluid to the two primary actuators (the lift and reach actuators) during part of the operating cycle, permits operation with balanced pressures in the two primary actuators and balanced dynamic effects during the operating cycle, thus permitting smooth operation and easy operator control. The assembly is also designed to maintain an appropriate attitude of the refuse container during the lift and dump portions of the operating cycle in order to minimize spillage of the contents of the container outside the collection bin.

Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations as would be appreciated by those having ordinary skill in the art to which the invention relates, and the same are intended to be comprehended within the meaning and range of equivalents of the appended claims.

What is claimed is:

1. A refuse collection vehicle having a front and a rear and comprising:

(a) a frame;

(b) a collection bin mounted on the frame;

(c) an apparatus for acquiring, lifting and transferring a container so as to deposit the contents of the container in the collection bin said apparatus comprising:

(i) a base link having a first end and a second end, which base link is mounted on the collection vehicle;

(ii) a container grab assembly that is adapted to capture the container;

(iii) an upper link having a first end and a second end;

(iv) a reach link having a first end and a second end, said first end being pivotally attached to the first end of the base link and said second end being pivotally attached to the upper link at an intermediate position between the first end and the second end;

(v) a lift arm having a first end and a second end, said first end being pivotally attached to the grab assembly;

(vi) a reach cylinder having a base end and a rod end, with one of such ends being pivotally attached to the base link at a position between the second end of the base link and the first end of the reach link and the other being pivotally attached to the second end of the upper link;

(vii) a lift cylinder having a base end and a rod end, with one of such ends being pivotally attached to the base link at an intermediate position between the first end and the second end and the other being pivotally attached to the second end of the lift arm;

(d) a collection compartment that is pivotally mounted on the rear of the vehicle;

(e) a storage compartment that is mounted on the frame between the collection bin and the collection compartment;

(f) a packer blade that is mounted within the collection compartment;

(g) means for moving the packer blade within the collection compartment so as to move refuse from the collection compartment into the storage compartment.

2. The refuse collection vehicle of claim 1 wherein the apparatus for acquiring, lifting and transferring a container so as to deposit the contents of the container in the collection bin includes:

(a) said reach cylinder having:

(i) a base end and a rod end, with one of such ends being pivotally attached to the second end of the base link and the other being pivotally attached to the second end of the upper link;

(ii) an extend port through which hydraulic fluid may be introduced to extend the rod end;

(iii) a retract port through which hydraulic fluid may be introduced to retract the rod end;

(b) said lift cylinder having:

(i) a base end and a rod end, with one of such ends being pivotally attached to the base link at an intermediate position between the first end and the second end and the other being pivotally attached to the second end of the lift arm;

(ii) an extend port through which hydraulic fluid may be introduced to extend the rod end;

(iii) a retract port through which hydraulic fluid may be introduced to retract the rod end;

(c) means for directing hydraulic fluid in parallel flow to the extend port of the reach cylinder and extend port of the lift cylinder to move the grab assembly from a first position adjacent to the base to a second position adjacent to the container;

(d) means for directing hydraulic fluid in parallel flow to the refract port of the reach cylinder and extend port of the lift cylinder to move the grab assembly from the second position adjacent to the container to a third position adjacent to the collection bin;

(e) means for directing hydraulic fluid in parallel flow to the extend port of the reach cylinder and retract port of the lift cylinder to move the grab assembly from the third position adjacent to the collection bin to the second position;

(f) means for directing hydraulic fluid in parallel flow to the retract port of the reach cylinder and retract port of the lift cylinder to move the grab assembly from the second position to the first position.

3. The refuse collection vehicle of claim 1 wherein the apparatus for acquiring, lifting and transferring a container so as to deposit the contents of the container in the collection bin includes:

(a) an upper link having a first end, a second end and a first and second intermediate positions between the first end and the second end, wherein said first intermediate position is nearer to the first end than the second end;

(b) a slave cylinder having a base end and a rod end, with one of such ends being pivotally attached to the reach link at an intermediate position between the first end and the second end, and the other being pivotally attached to the upper link at the first intermediate position;

and wherein the second end of the reach link is pivotally attached to the upper link at the second intermediate position.

4. The refuse collection vehicle of claim 1 wherein the grab assembly includes:

(a) a side support arm having a first end and a second end, the first end of which is attached to the lift arm;

(b) a gear box that is mounted on the second end of the side support arm and including a left gear and a right gear that are meshed together;

(c) a right shaft on which the right gear is mounted;

(d) a left shaft on which the left gear is mounted;

(e) a drive link having a first end and a second end, with said first end being mounted on the right shaft;

(f) a left grabbing arm which is mounted on the left shaft;

(g) a right grabbing arm that is mounted on the right shaft;

(h) a grabber cylinder having a base end and a rod end, with one of such ends being pivotally attached to the first end of the side support arm and the other being pivotally attached to the second end of the drive link.

5. The refuse collection vehicle of claim 4 wherein the relative positions of the drive link, the left and right gears and the left and right grabbing arms are such that retraction of the rod of the grabber cylinder from an extended position to a retracted position will cause the grabbing arms to close from an open position to a grab position.

6. The refuse collection vehicle of claim 4 wherein:

(a) the gear box is enclosed and has a first side and a second side;

(b) the right shaft extends through both the first and second sides of the gear box;

(c) the left shaft extends through the second side of the gear box;

(d) the second end of the drive link is mounted on the right shaft on the first side of the gear box;

(e) the right grabbing arm is mounted on the right shaft on the second side of the gear box;

(f) the left grabbing arm is mounted on the left shaft on the second side of the gear box.

* * * * *